US006814786B1

(12) United States Patent
Zhuang et al.

(10) Patent No.: US 6,814,786 B1
(45) Date of Patent: Nov. 9, 2004

(54) FILTERS INCLUDING SEGMENTED MONOLITHIC SORBENT FOR GAS-PHASE FILTRATION

(75) Inventors: Shuzhong Zhuang, Richmond, VA (US); John B. Paine, III, Midlothian, VA (US); Timothy S. Sherwood, Midlothian, VA (US); Jay A Fournier, Richmond, VA (US); Kent B. Koller, Chesterfield, VA (US); Zhaohua Luan, Midothian, VA (US); Charles E. Thomas, Jr., Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 10/404,441

(22) Filed: Apr. 2, 2003

(51) Int. Cl.[7] ..... B01D 53/04

(52) U.S. Cl. ..... 96/131; 96/134; 96/154; 131/202; 131/339

(58) Field of Search ..... 96/108, 131–135, 96/153, 154; 131/200–202, 207, 210, 215.2, 334, 339–345, 215.4

(56) References Cited

U.S. PATENT DOCUMENTS

| | | | | |
|---|---|---|---|---|
| 2,881,770 A | | 4/1959 | Touey | |
| 3,006,346 A | * | 10/1961 | Golding | 131/332 |
| 3,079,926 A | * | 3/1963 | Litchfield et al. | 131/339 |
| 3,101,723 A | | 8/1963 | Seligman et al. | |
| 3,353,543 A | | 11/1967 | Sproull et al. | |
| 3,388,707 A | * | 6/1968 | Harris | 131/339 |
| 3,744,497 A | * | 7/1973 | Marciuliano | 131/342 |
| 3,894,545 A | * | 7/1975 | Crellin et al. | 131/342 |
| 3,958,579 A | | 5/1976 | Baker | |
| 4,038,992 A | * | 8/1977 | Ogasa et al. | 131/342 |
| 4,226,250 A | * | 10/1980 | Ehrenpreis et al. | 131/187 |
| 4,379,465 A | | 4/1983 | Coq | |

(List continued on next page.)

FOREIGN PATENT DOCUMENTS

EP 0 532 329 A2 3/1993

OTHER PUBLICATIONS

T.D. Burchell et al., "*A Novel Process and Material for the Separation of Carbon Dioxide and Hydrogen Sulfide Gas Mixtures*," Carbon 35 pp. 1279–1294 (1997).

T.D. Burchell et al., "*Passive $CO_2$ Removal Using a Carbon Fiber Composite Molecular Sieve*," 37 Energy Conversion and Management pp. 947–954 (1996).

T.D. Burchell et al., Proceedings of 23rd Blennial Conference on Carbon, American Carbon Society p. 158 (1997).

*Primary Examiner*—Robert H. Spitzer
(74) *Attorney, Agent, or Firm*—Burns, Doane, Swecker & Mathis, L.L.P.

(57) ABSTRACT

A filter includes at least two monolithic sorbent segments and a mixing segment between the two monolithic sorbent segments. The monolithic sorbent segments comprise porous sorbent materials that are capable of selectively removing one or more selected gaseous constituents from a gas flow. The filter can be incorporated in a smoking article, such as a cigarette, to remove one or more selected constituents from mainstream smoke. Methods for making the filter and smoking articles including the filter, as well as methods for smoking a cigarette comprising the filter, are also provided.

45 Claims, 16 Drawing Sheets

U.S. PATENT DOCUMENTS 4,412,937 A 11/1983 Ikegami et al.
4,481,958 A 11/1984 Rainer et al.
4,677,995 A * 7/1987 Kallianos et al. ..... 131/335
4,700,723 A 10/1987 Yoshikawa et al.
4,753,717 A 6/1988 Yata et al.
4,772,508 A 9/1988 Brassell
4,774,972 A 10/1988 Hayes
4,820,681 A 4/1989 Chang et al.
4,917,835 A 4/1990 Lear et al.
4,933,314 A 6/1990 Marumo et al.
5,059,578 A 10/1991 Marumo et al.
5,191,905 A 3/1993 Tsukamoto
5,322,075 A 6/1994 Deevi et al.
5,360,023 A 11/1994 Blakley et al.
5,389,325 A 2/1995 Bookbinder et al.
5,409,021 A 4/1995 Safaev et al.
5,435,326 A 7/1995 Gentry et al.
5,499,636 A 3/1996 Baggett, Jr. et al.
5,510,063 A 4/1996 Gadkaree et al.
5,543,096 A 8/1996 Wu
5,549,125 A * 8/1996 White ..... 131/342
5,568,819 A 10/1996 Gentry et al.
5,591,368 A 1/1997 Fleischhauer et al.
5,632,286 A 5/1997 Berger et al.
5,666,976 A 9/1997 Adams et al.
5,685,986 A 11/1997 Yamada et al.
5,692,525 A 12/1997 Counts et al.
5,692,526 A 12/1997 Adams et al.
5,732,718 A 3/1998 Douglas et al.
5,733,451 A * 3/1998 Coellner et al. ..... 210/496
5,744,421 A 4/1998 Robinson et al.
5,820,967 A 10/1998 Gadkaree
5,827,355 A 10/1998 Wilson et al.
5,846,639 A 12/1998 Robinson et al.
5,914,294 A 6/1999 Park et al.
5,915,387 A 6/1999 Baggett, Jr. et al.
5,934,289 A 8/1999 Watkins et al.
5,972,253 A 10/1999 Kimber
5,988,176 A 11/1999 Baggett, Jr. et al.
6,026,820 A 2/2000 Baggett, Jr. et al.
6,030,698 A 2/2000 Burchell et al.
6,053,176 A 4/2000 Adams et al.
6,090,477 A 7/2000 Burchell et al.
6,206,007 B1 3/2001 Yoshida et al.
6,207,264 B1 3/2001 Robinson et al.
6,214,204 B1 4/2001 Gadkaree et al.
6,257,242 B1 7/2001 Stavridis
6,258,300 B1 7/2001 Burchell et al.
2002/0148478 A1 * 10/2002 Pera ..... 131/341
2002/0166563 A1 * 11/2002 Jupe et al. ..... 131/331
2003/0098030 A1 * 5/2003 Figlar et al. ..... 131/202
2003/0183237 A1 * 10/2003 Xue et al. ..... 131/202
2004/0040565 A1 * 3/2004 Xue et al. ..... 131/202

* cited by examiner

FILTERS INCLUDING SEGMENTED MONOLITHIC SORBENT FOR GAS-PHASE FILTRATION

FIELD OF THE INVENTION

The invention relates to gas filtration. More particularly, the invention relates to filters, such as cigarette filters, methods of making the filters, and methods of using the filters to filter gases, such as mainstream tobacco smoke.

BACKGROUND OF THE INVENTION

A number of filter materials have been suggested for incorporation into cigarette filters, including cotton, paper, cellulose, and certain synthetic fibers. However, such filter materials generally only remove particulate and condensable components from tobacco smoke, and thus are not optimal for the removal of gas-phase constituents from tobacco smoke.

Cigarettes incorporating filter elements with adsorbent materials have been described, for example, in U.S. Pat. Nos. 2,881,770 to Tovey; 3,353,543 to Sproull et al.; 3,101,723 to Seligman et al.; 4,481,958 to Ranier et al. and 5,568,819 to Gentry et al.; and in European Patent Application No. 532,329.

Different forms of carbon have been described for filtration applications. See, for example, U.S. Pat. Nos. 4,379,465; 4,412,937; 4,700,723; 4,753,717; 4,772,508; 4,820,681; 4,917,835; 4,933,314; 5,059,578; 5,191,905; 5,389,325; 5,510,063; 5,543,096; 5,632,286; 5,685,986; 5,732,718; 5,744,421; 5,820,967; 5,827,355; 5,846,639; 5,914,294; 5,972,253; 6,030,698; 6,090,477; 6,207,264; 6,214,204; 6,257,242 and 6,258,300; and the publications T. D. Burchell et al., "A Novel Process and Material for the Separation of Carbon Dioxide and Hydrogen Sulfide Gas Mixtures", 1997, *Carbon,* 35:1279-94; T. D. Burchell et al., "Passive $CO_2$ Removal Using a Carbon Fiber Composite Molecular Sieve", *Energy Conversion and Management,* 1996, 37:947-54; and T. D. Burchell et al., *Proceedings of 23rd Biennial Conference on Carbon,* American Carbon Society, 1997, p. 158.

Sectioned filters have been described, for example, in U.S. Pat. Nos. 3,958,579; 4,774,972; 5,360,023; 5,409,021; 5,435,326; 6,206,007 and 6,257,242.

Despite these developments in filtration, there is a continued need for improved filters and methods for filtering gases.

SUMMARY OF THE INVENTION

The invention provides filters suitable for gas filtration. A preferred embodiment of a filter comprises a sorbent including at least two sorbent segments, and a mixing region between two adjacent sorbent segments. The mixing region can be a space and/or it can include at least one mixing segment. The filter can remove at least one selected gas-phase constituent from a gas flow.

In a preferred embodiment, the sorbent includes activated carbon. In another preferred embodiment, the sorbent includes at least one molecular sieve material. In yet another preferred embodiment, the sorbent includes two or more different sorbent materials.

In a preferred embodiment, the sorbent segments include one or more flow channels. Different sorbent segments of the same filter can have the same or a different flow channel configuration to provide tailored filtration and/or fluid flow performance characteristics.

In a preferred embodiment, the filter is a cigarette filter including a mixing region between two adjacent sorbent segments. The filter is capable of removing one or more selected gas-phase constituents from mainstream tobacco smoke.

In another preferred embodiment, a smoking article comprises a filter including a mixing region between two sorbent segments, which is capable of selectively removing one or more selected gas-phase constituents from mainstream smoke.

A preferred embodiment of a method of making a cigarette filter comprises incorporating a filter including sorbent segments and one or more mixing regions into a filter. A preferred embodiment of a method of making a cigarette comprises placing a paper wrapper around a tobacco rod, and attaching such cigarette filter to the tobacco rod to form the cigarette.

A preferred embodiment of a method of smoking a cigarette comprises lighting or heating the cigarette to form smoke and drawing the smoke through the cigarette, where the cigarette comprises a filter including sorbent segments and one or more mixing regions.

DETAILED DESCRIPTION OF PREFERRED EMBODIMENTS

Figure 1:
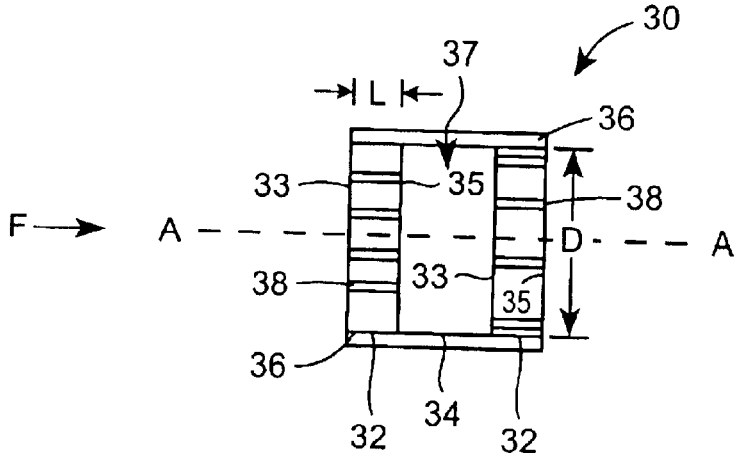
FIG. 1 illustrates an embodiment of a filter including sorbent segments and a mixing region.

Filters capable of selectively removing selected gas-phase constituents from gases are provided. The filters can be used in various filtration applications, such as in smoking articles, ashtrays for smoking articles including a fan and such filter, in commercial and/or industrial air filtration devices and systems, and in household filters.

In a preferred embodiment, the filter comprises a sorbent, which includes at least two sorbent segments, and at least one mixing region between two adjacent sorbent segments. The sorbent can be chosen from various porous materials that are capable of removing gas-phase constituents from gas flows. In a preferred embodiment, the sorbent comprises activated carbon. In another preferred embodiment, the sorbent comprises one or more molecular sieve materials. In yet another preferred embodiment, the sorbent comprises activated carbon and one or more molecular sieve materials.

The mixing region can be a space and/or it can include a mixing segment. The mixing region promotes mixing of gas that has passed through one monolithic sorbent segment, before the gas enters an adjacent sorbent segment. The mixing region can increase gas recombination, thereby enhancing the filtration selectivity of the filter.

The sorbent segments preferably include at least one gas flow channel, and more preferably a plurality of gas flow channels. The flow channels can have selected configurations. For example, the flow channel cross-sectional size, flow channel length, number of flow channels and/or the flow channel orientation with respect to the axial direction of the filter, can be varied in a selected number of the sorbent segments of a filter to vary the tortuosity of the gas flow path through the filter. In a preferred embodiment, the flow channel structures in different sorbent segments of a filter have different gas filtration performance characteristics from each other.

In another preferred embodiment, the sorbent segments of the filter comprise one or more different molecular sieve materials that have selected pore structures for targeted removal of selected gas-phase constituents from gases. The sorbent segments also can comprise activated carbon and one or more molecular sieve materials.

In a preferred embodiment, the filter is provided in a smoking article, such as a cigarette. The filter preferably includes at least two sorbent segments and at least one mixing region between two adjacent sorbent segments.

Preferred embodiments of methods of making the filter are also described.

Preferred embodiments of methods of making filters and smoking articles, and methods of smoking cigarettes including preferred embodiments of the filters, are also described.

As used herein, the term "sorption" denotes filtration by adsorption and/or absorption. Sorption is intended to encompass interactions on the outer surface of the sorbent, as well as interactions within the pores and channels of the sorbent. In other words, a "sorbent" is a substance that has the ability to condense or hold molecules of other substances on its surface and/or the ability to take up other substances, i.e., through penetration of the other substances into its inner structure or into its pores. The term "sorbent" as used herein refers to either an adsorbent, an absorbent, or a material that can function as both an adsorbent and an absorbent. As used herein, the term "remove" refers to adsorption and/or absorption of at least some portion of a component of mainstream tobacco smoke.

The term "mainstream" smoke includes the mixture of gases passing down the tobacco rod and issuing through the filter end, i.e., the amount of smoke issuing or drawn from the mouth end of a smoking article during smoking of the smoking article. The mainstream smoke contains air that is drawn in through the tobacco of the smoking article, as well as through the paper wrapper.

The term "molecular sieve" as used herein refers to a porous structure comprising an inorganic material and/or organic material. Molecular sieves include natural and synthetic materials.

The sorbent segments of the filter have microporous, mesoporous and/or macroporous pore structures. The term "microporous molecular sieve" generally refers to such material with a pore size of about 20 Å or less. The term "mesoporous molecular sieve" generally refers to a material with a pore size of about 20–500 Å. A "macroporous molecular sieve" is a material with a pore size of about 500 Å or larger. Microporous, mesoporous and/or macroporous molecular sieve materials can be used in preferred embodiments of the filter. Molecular sieve materials can be selected based on their ability to remove one or more selected gas-phase constituents from a gas, such as mainstream tobacco smoke.

Preferred embodiments of the filter can be used in smoking articles including, but not limited to, cigarettes, cigars and pipes, as well as non-traditional cigarettes. Non-traditional cigarettes include, for example, electrically heated cigarettes for electrical smoking systems as described in commonly-assigned U.S. Pat. Nos. 6,026,820; 5,988,176; 5,915,387; 5,692,526; 5,692,525; 5,666,976 and 5,499,636, each of which is incorporated herein by reference in its entirety.

In a preferred embodiment, the filter includes two or more sorbent segments and at least one mixing region between two adjacent monolithic sorbent segments. The sorbent segments preferably have a monolithic construction. FIG. 1 illustrates a preferred embodiment of the filter 30 including two sorbent segments 32 and a single mixing region 34 between the sorbent segments 32. As described herein, the mixing region 34 can be a space, and/or it can comprise at least one mixing segment 37 that partially or completely fills the space between the sorbent segments 32. The filter 30 can also comprise an optional sleeve 36. The sorbent segments 32 and mixing segment 37 preferably are maintained substantially fixed by the sleeve 36. The sorbent segments 32 have a maximum dimension D. For example, for a sorbent segment having a disk configuration, D is the diameter.

Figure 2:
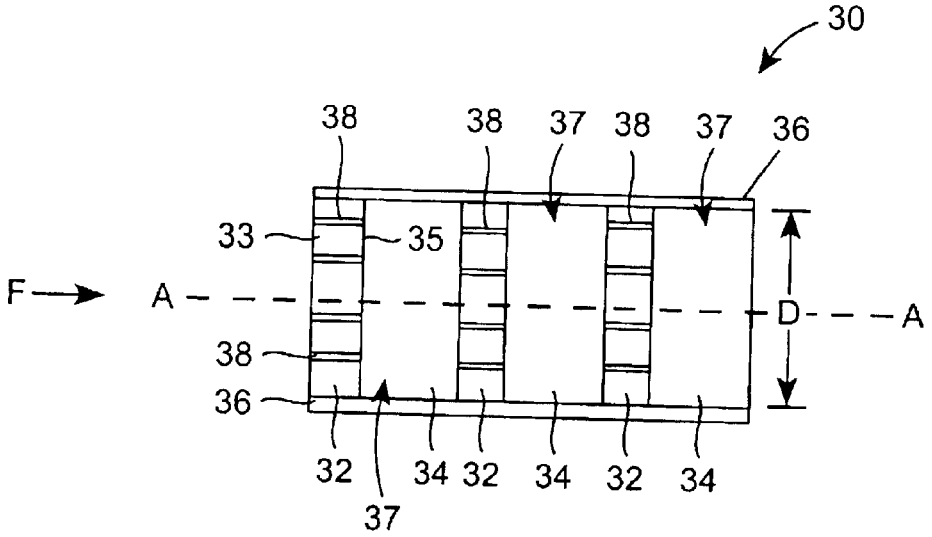
FIG. 2 illustrates another embodiment of a filter including multiple sorbent segments and mixing regions between the sorbent segments.

FIG. 2 illustrates another preferred embodiment of the filter 30 including three sorbent segments 32 and three mixing segments 37 surrounded by an optional sleeve 36. In this embodiment, two mixing segments 34 are defined between adjacent pairs of sorbent segments 32. The mixing segments 37 can partially or completely fill the mixing regions 34 between the adjacent sorbent segments 32.

Other preferred embodiments of the filter 30 can have different numbers, arrangements and/or orientations of the sorbent segments 32 and/or mixing segments 37 than the filters 30 shown in FIGS. 1 and 2.

The sorbent segments 32 comprise one or more porous sorbent materials. The sorbent segments 32 have an inlet face 33, at which gas enters the sorbent segment, and an outlet face 35, at which gas exits the sorbent segment. In addition, the sorbent segments 32 include one or more gas flow channels 38 extending through the thickness of the sorbent segments in the direction of gas flow F through the sorbent segments. The sorbent segments 32 shown in FIGS. 1 and 2 have a plurality of axially extending flow channels 38 extending from the inlet face 33 to the outlet face 35. In a preferred embodiment, the sorbent segments 32 can include from 1 to about 100 flow channels 38.

The flow channels 38 can be linear as shown in FIGS. 1 and 2. As depicted, the flow channels 38 can be parallel to the axial direction A—A of the filter 30. Alternatively, the flow channels 38 can be non-parallel to the axial direction A—A. However, the flow channels 38 are not limited to linear configurations and each flow channel can include, for example, two or more linear sections having respectively different gas flow directions, and the same or different gas flow lengths, through the sorbent segment.

Also, the flow channels 38 can have any suitable cross-sectional shape, such as, for example, circular, oval, rectangular, square, triangular, other polygonal cross-sectional shapes, or irregular shapes, such as T-shapes. Different flow channels 38 in a given sorbent segment 32 can have the same or different dimensions and/or cross-sectional shapes with respect to each other.

The sorbent segments 32 can comprise various porous sorbent materials that provide desired sorption characteristics for the filter 30. In a preferred embodiment, the sorbent segments 32 comprise activated carbon. The activated carbon can be in various forms including particles, fibers, beads, conglomerates of any of these forms, and the like. The activated carbon can have selected porosity characteristics, such as pore size, total pore volume and/or specific surface area.

In another preferred embodiment, the sorbent segments 32 comprise one or more molecular sieve sorbents. Molecular sieve sorbents that may be used in the sorbent segments include, for example, one or more of the zeolites, mesoporous silicates, alumino phosphates, and other porous materials, such as mixed oxide gels, which may optionally further comprise inorganic or organic ions and/or metals.

In a preferred embodiment, the sorbent segments include one or more zeolites. Zeolites include crystalline aluminosilicates having channels or pores of uniform, molecular sized dimensions. There are many known unique zeolite structures having channels or pores with different sizes and shapes, which can significantly affect the sorption and separation performance characteristics of the zeolites. Zeolites can separate molecules by size and shape effects and/or by differences in strength of sorption. One or more zeolites having channels or pores larger than one or more selected gas-phase constituents of a gas that is/are desired to be filtered can be used in the sorbent segments, such that only selected molecules that are small enough to pass through the pores of the molecular sieve material(s) are able to enter the cavities and be sorbed by the zeolite(s).

The zeolite can be, but is not limited to, one or more of zeolite A; zeolite X; zeolite Y; zeolite K-G; zeolite ZK-5; zeolite BETA; zeolite ZK-4 and zeolite ZSM-5.

In another preferred embodiment, the sorbent segments 32 of the filter 30 are made of composite materials. For example, the sorbent segments can comprise activated carbon and one or more molecular sieve materials, such as those materials described above.

The sorbent segments 32 in the filter 30 can have the same or a different composition from each other. Accordingly, sorbent segments can be selected to provide different sorption capabilities in a filter. In addition, sorbent segments can be selectively arranged in the filter so that the selectivity of the individual sorbent segments may significantly affect the overall filtration performance characteristics of the filter.

Monolithic sorbent segments 32 can have different shapes and/or sizes. For example, the monolithic sorbent segments 32 can have a disk shape, a sheet-like shape, or the like. The sorbent segments 32 can have various cross-sectional shapes, such as circular, oval, rectangular, square, other polygonal cross-sectional shapes, non-geometric shapes, and the like.

The sorbent segments 32 can have different shapes and sizes suitable for the configuration of the gas flow passage in which they are used. In a preferred embodiment, the maximum dimension D of the sorbent segments is related to the size of the gas flow passage in which the filter 30 is used. For example, when the filter 30 is used in a cigarette to filter mainstream smoke, the sorbent segments can have a slightly smaller diameter D than the diameter of the filter. For example, the diameter of such sorbent segments can be about 8 mm, which is a typical cigarette diameter. In embodiments in which the filter is used in a smoking article other than a cigarette, the sorbent segments can have dimensions based on the configuration and size of the particular smoking article. For example, when used in a cigar, the sorbent segments preferably have a maximum dimension D slightly less than the diameter of the cigar. Likewise, the sorbent segments can be sized to fit within the flow passage of a cigarette holder, pipe or other smoking article.

In a preferred embodiment, the length L (thickness) of the sorbent segments is less than about 5 mm, more preferably from about 0.5 mm to about 2 mm. The sorbent segments are preferably sized to provide desirable rigidity for manufacturing and handling purposes, as well as a suitable pressure drop across their length.

The inlet face 33 and outlet face 35 of the sorbent segments 32 can be substantially flat. However, the inlet face and/or outlet face of the sorbent segments can alternatively be non-flat. For example, the inlet face and/or outlet face can be convex, concave, include protuberances, such as bumps, ridges or the like, and/or depressions, such as dimples, grooves or the like, to increase the facial surface area of the sorbent segment and thus change its filtration capabilities.

The mixing segments 37 of the filter 30 can comprise various materials. The material preferably is not in a loose particulate form, such as loose powder or granules. The material can be, for example, cellulose acetate, cellulose triacetate, polypropylene, polyester, activated carbon fibers, activated carbon felts, activated carbon beads, silica gel, APS silica gel, molecular sieves, or combinations thereof. In a preferred embodiment, the mixing segments 37 have a configuration and a maximum dimension substantially the same as the sorbent segments 32.

The composition and shape and/or dimensions of a mixing segment 37 can be selected to provide a desired gas pressure drop across the mixing segment, such as, for example, to provide a desired resistance-to-draw (RTD) of the filter in a smoking article. The mixing segments preferably enhance mixing of gas by increasing gas turbulence. By increasing gas mixing, the sorption efficiency and selectivity of the sorbent segments in the filter preferably are enhanced. In a preferred embodiment, a mixing segment 34 is placed between each adjacent pair of sorbent segments 32 in the filter 30.

The sleeve 36 of the filter 30 can be composed of a suitable material that retains the sorbent segments and mixing segments. In a preferred embodiment, the sleeve is made of paper or the like.

As used herein, the term "total facial surface area" of a sorbent segment 32 means the total surface area of the inlet face 33 and the outlet face 35. Accordingly, increasing the number of sorbent segments 32 in the filter 30 increases the total number of inlet faces 33 and outlet faces 35 of the filter, thereby increasing the total facial surface area provided by the sorbent segments 32 in the filter 30. For example, by substituting two sorbent segments having a given total length for a single sorbent segment having the same configuration as, and a length equal to the total length of, the two sorbent segments, the total facial surface area of the inlet and outlet faces of sorbent segments in the filter is doubled. Increasing the total facial surface area of the sorbent segments 32 preferably increases the adsorption efficiency of one or more gas-phase constituents by the filter 30. Accordingly, in a preferred embodiment, the number of the sorbent segments in the filter is greater than two, such as, for example, three, four, five or more sorbent segments, to provide a desired total facial surface area of the sorbent segments. In such embodiments, one or more adjacent pairs of the sorbent segments are preferably separated by a mixing segment.

The total facial surface area of a sorbent segment can also be varied by changing its orientation in the filter. In FIGS. 1 and 2, the general direction of gas flow through the filter 30 is axial as represented by arrow F. In both embodiments, the inlet face 33 and outlet face 35 of the sorbent segments 32 are substantially perpendicular to the axial direction A—A of the filter 30.

Figure 3:
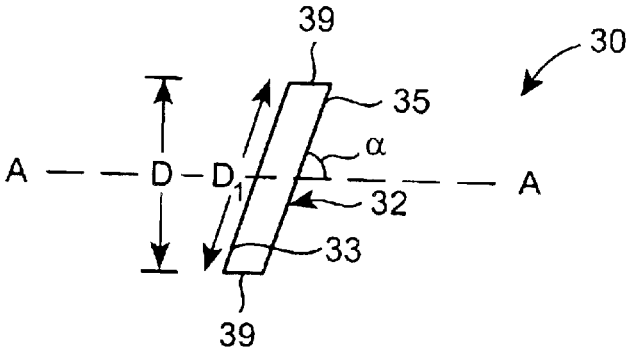
FIG. 3 illustrates an alternative angular orientation of a sorbent segment of a filter.

However, in another preferred embodiment of the filter, the sorbent segments can be arranged in the filter in various (non-perpendicular) angular orientations relative to the axial direction A—A. For example, in a preferred embodiment of the filter 30 shown in FIG. 3, the inlet face 33 and outlet face 35 of the sorbent segment 32 are oriented at an acute angle $\alpha$ with respect to the axial direction A—A of the filter 30 (only one sorbent segment 32 is shown for simplicity). The edges 39 are preferably parallel to the axial direction A—A. By orienting the sorbent segment(s) 32 in a filter 30 at such angle, preferably within a sleeve 36, the facial surface area of the sorbent segment exposed to gas flow is increased. Particularly, orienting a sorbent segment at an acute angle $\alpha$ increases the maximum dimension D to D, (i.e., $D_1$=D/sin $\alpha$), which increases the total facial surface area of the sorbent segment.

Figure 4:
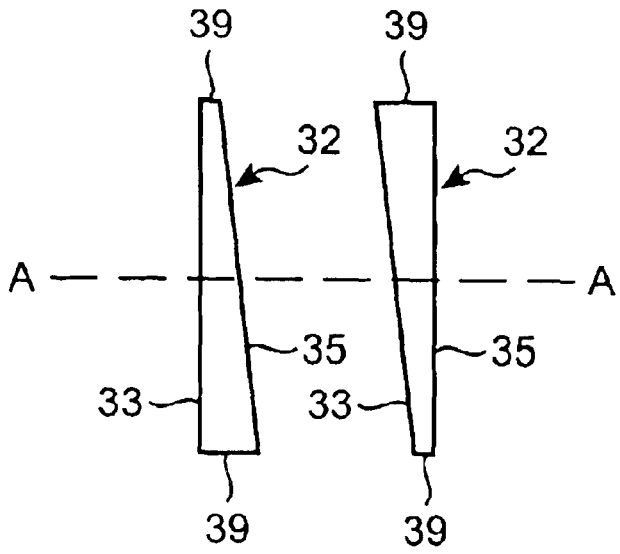
FIG. 4 illustrates an alternative configuration of sorbent segments of a filter.

Referring to FIG. 4, in another preferred embodiment, the outlet face 35 of a first sorbent segment 32 and the inlet face 33 of an adjacent second sorbent segment 32 can be oriented at substantially the same angle, while the inlet face 33 of the first sorbent segment and the outlet face 35 of the second sorbent segment can be perpendicular, with respect to the axial direction A—A of the filter.

Figure 5:
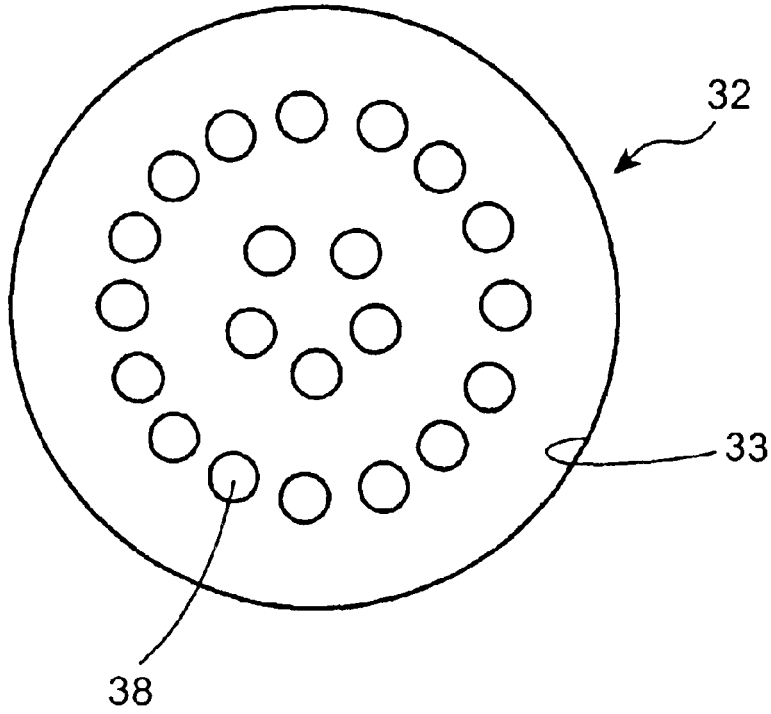
FIG. 5 illustrates a preferred embodiment of a pattern of flow channels in a sorbent segment.

In different preferred embodiments of the filter 30, the flow channels 38 can have a selected number, size and/or spatial arrangement in the sorbent segment 32 to provide desired gas flow and filtration performance characteristics. For example, the flow channels can have a regular or random arrangement. An exemplary concentric pattern of flow channels 38 in a sorbent segment 32 is shown in FIG. 5.

The flow channels 38 preferably have a maximum cross-sectional dimension (width or length) of from about 0.1 mm to about 5 mm, and more preferably from about 0.1 mm to about 2 mm. The size of the flow channels 38 can be varied in the sorbent segments 32 to vary the cross-sectional flow area through the flow channels and/or the surface area of the walls defining the flow channels. Increasing the surface area of the wall defining a given flow channel increases the total surface area for sorption of gas-phase constituents on the wall. Increasing the number of flow channels having a given size also increases the total surface area of the walls of the flow channels of a sorbent segment, thereby providing increased surface area for sorption of gas-phase constituents on the walls. In addition, the orientation of the flow channels relative to the inlet face and outlet face can be varied to increase the length of the flow channels, and thus the wall surface area available for sorption. Accordingly, the size, number and/or orientation of the flow channels can be varied to control sorption of gas-phase constituents.

The size and number of the flow channels 38 also can be varied to change the pressure drop across the thickness dimension of the sorbent segment 32. For example, the flow channel cross-sectional area can be increased to generally decrease the pressure drop to achieve a desired resistance to gas flow through the sorbent segment.

In a preferred embodiment, at least one sorbent segment 32 of the filter 30 has a different arrangement of flow channels 38 than other sorbent segments, and/or has flow channels misaligned with the flow channels of an adjacent sorbent segment (with the sorbent segments preferably separated from each other by a mixing segment), so as to increase the tortuosity of fluid flow in the space between the sorbent segments. By increasing the tortuosity of fluid flow between the sorbent segments, removal of gas-phase constituents from a gas stream can be enhanced. In a preferred embodiment, each sorbent segment has a different flow channel pattern and/or the flow channels of adjacent sorbent segments are misaligned from each other. By providing selected flow channel structures in individual sorbent segments, the sorption efficiency and selectivity of the sorbent segments can be enhanced.

Figure 6:
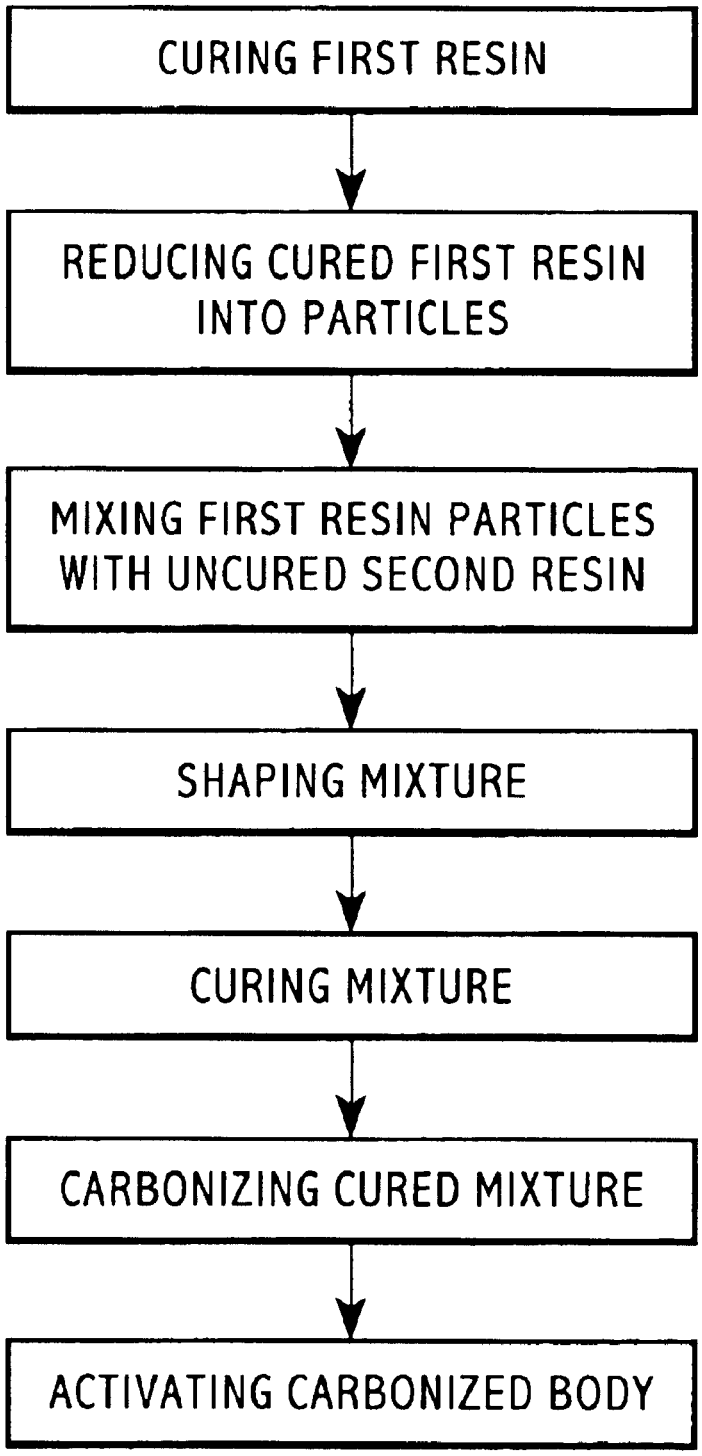
FIG. 6 illustrates a first preferred embodiment of a method of making a sorbent segment.

The sorbent segments of the filter can be made by various suitable methods. Referring to FIG. 6, in a first preferred embodiment of a method of manufacturing monolithic sorbent segments, a first resin is cured to cross-link the resin and produce a cured material. The cured first resin is mixed with an uncured second resin to produce a mixture. The mixture is cured by heating, followed by carbonizing and activating to produce an activated carbon-containing sorbent.

In this embodiment, the first resin is preferably a phenolic resin. The phenolic resin can be a resole-type, self-curing phenolic resin; a novolak-type phenolic resin, which is combined with a curing agent that promotes cross-linking; or a mixture of one or more resole-type phenolic resins and/or one or more novolak-type phenolic resins. The curing agent used with the novolak-type phenolic resin can be, for example, hexamethylenetetramine, ethylenediamine-formaldehyde products, anhydroformaldehyde-aniline, methylol derivatives of urea or melamine, paraformaldehyde and the like. The first resin can be carbonized by heating, as described below. The first resin is preferably entirely in powder form.

The curing temperature of the first resin is selected based on factors including the resin composition and the curing time. For example, phenolic resin can be cured in a suitable atmosphere, such as air, at a preferred temperature of from about 120° C. to about 160° C., and more preferably from about 140° C. to about 150° C. The curing time of phenolic resin decreases with increased temperature. During curing, the first resin can be contained in a suitable vessel, such as a ceramic crucible or the like.

The cured first resin is a solid mass. The solid mass of the cured first resin is reduced to particle form of a desired size. The cured first resin is preferably reduced to particles by a mechanical impaction technique, such as milling (for example, jet milling) or crushing. In a preferred embodiment, the cured first resin particles have a particle size of from about 5 microns to about 100 microns, and more preferably from about 10 microns to about 30 microns.

Optionally the cured first resin particles can be sized to provide a desired particle size distribution. For example, the cured first resin particles can be screened or air classified to achieve a desired particle size distribution.

The cured first resin particles are mixed with an uncured second resin. The uncured second resin can be the same resin as, or a different resin from, the first resin. If the uncured second resin contains a novolak-type phenolic resin, a curing agent that promotes cross-linking of this resin is also added to the mixture. The uncured second resin preferably is in powder form and preferably has a particle size that is approximately equal to the particle size of the cured first resin particles. By using approximately equally sized cured first resin particles and uncured second resin particles, a more uniform mixture of these particles can be obtained.

In the embodiment, the mixing ratio of the cured first resin particles to the uncured second resin particles preferably promotes bonding of the cured and uncured particles. Preferably, the amount of the uncured second resin in the mixture is selected to achieve sufficient bonding of the cured first resin particles to each other so that the shape of the cured mixture can be maintained. In a preferred embodiment, the ratio by weight of the cured resin to the uncured resin is from 4:1 to about 4:3.

In a preferred embodiment, the mixture of the cured first resin particles and the uncured second resin particles is shaped into a desired shape. For example, the mixture can be shaped by compaction, molding or extrusion. In a preferred embodiment, the mixture is placed in a vessel or in a cavity of a mold or die having a desired shape and size, which corresponds approximately to the desired shape and size of the sorbent segment. For example, the vessel or cavity can be cylindrical, polygonal, or disk shaped.

Optionally, the mixture of the cured first resin particles and the uncured second resin particles can be shaped by applying pressure to the mixture. For example, when the mixture is contained in a cavity of a mold or die, pressure can be applied to the mixture with a punch to increase its packing density. In other preferred embodiments, the mixture is not subjected to pressure (i.e., other than pressure exerted on the mixture by walls of the vessel or mold) to further shape the mixture or increase its packing density. In such embodiments, the mixture can be loosely filled in a cavity of a mold or die or other vessel.

The mixture is then cured. The mixture can be placed in a suitable atmosphere, such as air, at a preferred temperature of from about 120° C. to about 160° C., and more preferably from about 140° C. to about 150° C. The mixture is preferably cured at a lower temperature and for a longer curing time than the first resin, as described above. Consequently, the mixture is cured slowly and the shape of the mixture is substantially retained during curing. The final curing temperature can be reached slowly to minimize distortion of the body. For example, the mixture can be heated at a first temperature less than the final curing temperature for a selected period of time, and then heated to a final curing temperature. The cured mixture is a monolith having a desired pre-shape.

In the embodiment, the cured monolith is carbonized by heating at a selected temperature for an effective amount of time to sufficiently carbonize the mixture to produce a carbonized body. For example, the mixture can be heated at from about 700° C. to about 1000° C. for from about 1 hour to about 20 hours in an inert or reducing atmosphere to carbonize the first and second resins in the mixture. The gas atmosphere can contain, for example, nitrogen and/or argon. Preferably, the carbonizing atmosphere does not contain oxygen, which reacts with carbon and would remove material from the carbonized body. Typically, the "percent yield" (i.e., percent yield=(100)×(final weight of carbonized body after carbonization/initial weight of monolith before carbonization)) of the first and second resins in the carbonized body is at least about 55%. Typically, the carbonized body produced from the cured monolith contains at least about 95% carbon.

The carbonized body is then activated to develop a desired pore structure in the activated body. Activation can be conducted for example, in an oxygen-containing atmosphere, such as in steam, carbon dioxide, oxygen or mixtures thereof. Oxygen in the atmosphere reacts with carbon, thereby producing pores. In a preferred embodiment, the activation is conducted at a temperature of from about 800° C. to about 1000° C., and for a period of from about 30 minutes to about 5 hours.

In preferred embodiments, the carbonized body is activated to achieve a desired "percent burn-off", which represents the weight loss [i.e., percent burn-off=(100)×(initial weight before activation−final weight after activation)/initial weight before activation] of the carbonized body that occurs during activation. As the level of burn-off is increased, the pore surface area increases. In a preferred embodiment, the BET (Brunauer, Emmett and Teller) surface area of the activated carbon-containing sorbent after the activation step is from about 500 $m^2/g$ to about 1,500 $m^2/g$. Burn-off can be controlled to control the pore size, pore volume and density of the monolithic sorbent. For example, one or more of the activation atmosphere, activation gas flow rate, activation temperature and activation time can be varied to control the pore structure of the sorbent.

Figure 7:
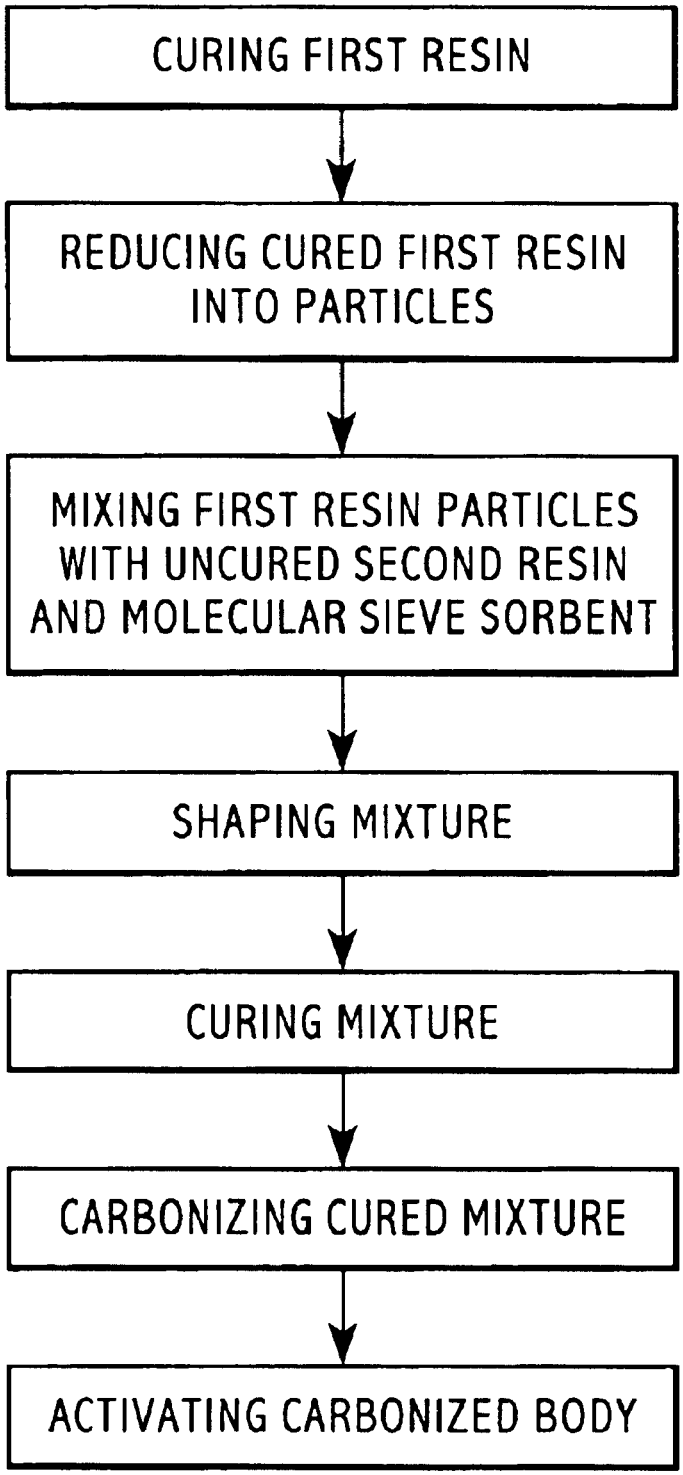
FIG. 7 illustrates a second preferred embodiment of a method of making a sorbent segment.

Referring to FIG. 7, a second preferred embodiment of a method of making monolithic sorbent segments of a filter comprises adding at least one molecular sieve material to a mixture of the cured first resin particles and the uncured second resin particles described above with respect to the first preferred embodiment of the method of making the sorbent (FIG. 6). In the second preferred embodiment, steps described above with respect to the first embodiment preferably are then performed to produce a composite sorbent including activated carbon and the molecular sieve material. The molecular sieve material is added to the mixture of the cured first resin and uncured second resin to provide pores and channels of a selected size in the sorbent segment.

Composite sorbent segments produced by methods according to the second preferred embodiment can provide a controlled pore structure, including a controlled amount and size of pores provided by activation of the carbonized body preferably by techniques described above, as well as pores of a selected size provided by the molecular sieve material.

The pores of the sorbent segments 32 provided in the filter 30 preferably are larger than the molecules of one or more selected gas-phase constituents of mainstream tobacco smoke that are desired to be removed. Only those gas-phase constituents of the mainstream tobacco smoke that are small enough to enter into the pores of the sorbent segments can be adsorbed on the interior surface of the pores. Thus, gas-phase constituents of mainstream tobacco smoke having small molecular structures are selectively sorbed by the sorbent, while larger constituents, such as those contributing to flavor, remain in the smoke.

In a preferred embodiment, the sorbent segments manufactured by the above-described preferred embodiments, or by an alternative method, are processed to form the flow channels. The flow channels can be formed by a suitable process such as, for example, molding, extrusion, ultrasonic drilling, etching, or laser machining. As described above, the flow channels can have various sizes, shapes, orientations and patterns in the sorbent segments.

The sorbent segments can be formed directly by making a monolithic body of sorbent material by one of the above-described preferred embodiments, or by another suitable method, or alternatively by making the monolithic body and then slicing the body into a plurality of sorbent segments of desired lengths. For example, the sorbent segments can be formed by cutting or sawing a monolithic sorbent rod to form sorbent segments.

As described above, the pore size of activated carbon sorbent can be modified or adjusted by controlling the percentage burn-off during activation. Sorbents other than activated carbon can have a selected pore structure as well.

In preferred embodiments, the sorbent of the filter selectively removes one or more gas-phase constituents including, but not limited to, 1,2-propadiene, 1,3-butadiene, isoprene, 1,2-pentadiene, 1,3-cyclopentadiene, 2,4-hexadiene, 1,3-cyclohexadiene, methyl-1,3-cyclopentadiene, benzene, toluene, p-xylene, m-xylene, o-xylene, styrene (vinylbenzene), 1-methylpyrrole, formaldehyde, acetaldehyde, acrolein, propionaldehyde, isobutyraldehyde, 2-methyl isovaleraldehyde, acetone, methyl vinyl ketone, diacetyl, methyl ethyl ketone, methyl propyl ketone, methyl 2-furyl ketone, hydrogen cyanide and acrylonitrile. Selective removal of mainstream tobacco smoke constituents can be achieved by sorbent having pores larger than those selected gas-phase constituents that are desired to be removed from mainstream tobacco smoke. In a preferred embodiment, the average pore size of the sorbent is less than about 20 Å, and more preferably less than about 15 Å.

In a preferred embodiment, the filter is incorporated in a smoking article. The amount of the sorbent included in the smoking article can be varied. For example, up to about 300 mg of sorbent can typically be used in a cigarette or other smoking article. For example, within the usual range, amounts such as about 20, 30, 50, 75, 100, 150, 200, or 250 mg of the sorbent can be used in a cigarette. The amount of monolithic sorbent used in a cigarette depends on the amount of constituents in the tobacco smoke, and the amount of the constituents that is desired to be removed from the tobacco smoke.

The filter including sorbent segments and one or more mixing regions can be used in various cigarette filter constructions. Exemplary cigarette filter constructions include, but are not limited to, a mono filter, a dual filter, a triple filter, a cavity filter, a recessed filter or a free-flow filter. Mono filters typically contain cellulose acetate tow or cellulose paper. Dual filters typically comprise a cellulose acetate mouth side plug and a pure cellulose segment or cellulose acetate segment. In such dual filters, the sorbent is preferably provided on the smoking material or tobacco side. The length and pressure drop of the two segments of the dual filter can be adjusted to provide optimal adsorption, while maintaining acceptable draw resistance. Triple filters can include mouth and smoking material or tobacco side segments, while the middle segment comprises a material or paper containing the activated carbon-containing sorbent. Cavity filters typically include two segments, for example, acetate-acetate, acetate-paper or paper-paper, separated by a cavity containing the activated carbon-containing sorbent. Other suitable filter materials include, for example, cellulose triacetate, polyester web, polypropylene web and polypropylene tow. Recessed filters include an open cavity on the mouth side, and typically incorporate the filter into the plug material. The filters may also optionally be ventilated, and/or comprise additional sorbents (such as charcoal or magnesium silicate), catalysts, flavorants, and/or other additives.

FIGS. 8–15 illustrate cigarettes 2 including different filter constructions in which embodiments of the filter 30 including two or more monolithic sorbent segments 32 and one or more mixing regions 34 can be incorporated (for example, the filters 30 shown in FIGS. 1–5). In each of these embodiments, the filter 30 can be incorporated in the filter portion 6 of the cigarette, and a desired amount of the monolithic sorbent can be provided in the filter portion 6 by varying the size, number and/or density (for example, by material selection or varying the porosity) of the sorbent segments, or by incorporating more than one filter 30 in the cigarette.

Figure 8:
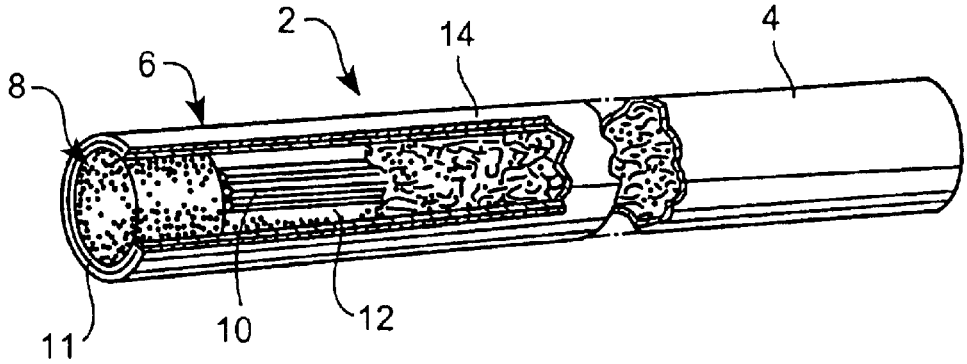
FIG. 8 illustrates a cigarette including an embodiment of a filter having a tubular filter clement.

FIG. 8 illustrates a cigarette 2 including a tobacco rod 4, a filter portion 6, and a mouthpiece filter plug 8. An embodiment of the filter 30 including two or more sorbent segments 32 and one or more mixing regions 34 can be incorporated with the folded paper 10, which is disposed in the hollow interior of a free-flow sleeve 12 forming part of the filter portion 6.

Figure 9:
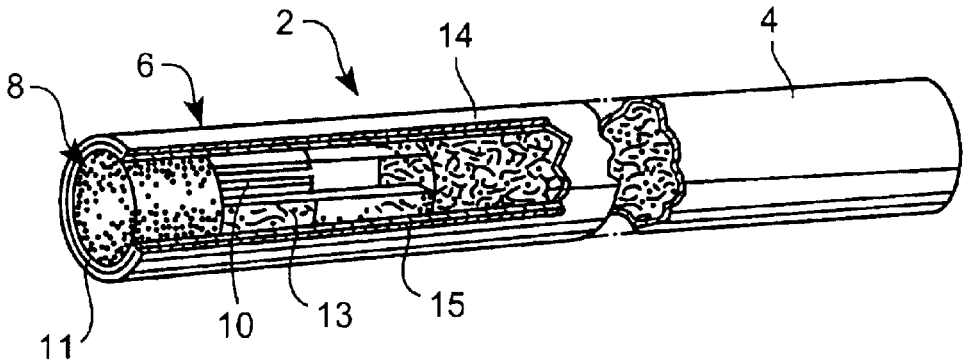
FIG. 9 illustrates a cigarette including another embodiment of the filter having a first free-flow sleeve next to a second free-flow sleeve.

FIG. 9 depicts a cigarette 2 including a tobacco rod 4 and a filter portion 6. Paper 10 is disposed in the hollow cavity of a first free-flow sleeve 13 located between the mouthpiece filter plug 8 and a second free-flow sleeve 15. In the cigarettes shown in FIGS. 8 and 9, the tobacco rod 4 and the filter portion 6 are joined together with tipping paper 14. In both cigarettes, the filter portion 6 may be held together by filter overwrap 1. In this embodiment, the filter 30 can be incorporated into the filter portion of the cigarette, for example, in place of, or as part of, the second free-flow sleeve 15.

Figure 10:
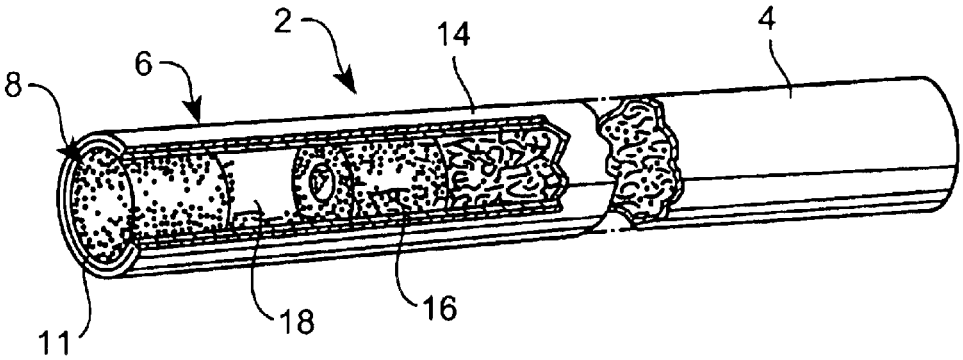
FIG. 10 illustrates a cigarette including a further embodiment of the filter having a plug-space-plug filter element.

FIG. 10 shows another preferred embodiment of the cigarette 2 including a tobacco rod 4 and a filter portion 6 with a plug-space-plug filter including a mouthpiece filter plug 8, plug 16 and space 18. The plug 16 can be a tube or solid piece of material, such as, for example, polypropylene or cellulose acetate fibers. The tobacco rod 4 and the filter portion 6 are joined together with tipping paper 14. The filter portion 6 can include a filter overwrap 11. The filter 30 can be substituted for the plug 16, for example.

Figure 11:
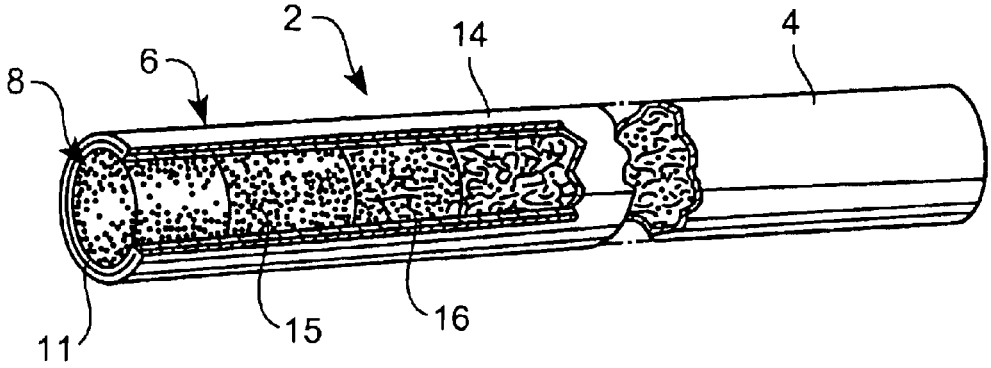
FIG. 11 illustrates a cigarette including yet another embodiment of the filter having a three-piece filter element with three plugs.

FIG. 11 shows a cigarette 2 including a tobacco rod 4 and filter portion 6 joined together with tipping paper 14. This embodiment is similar to the cigarette depicted in FIG. 10 except that the space 18 contains a sorbent 15. The cigarette also includes a filter overwrap 11. In this embodiment, the filter 30 substituted for the sorbent 15, for example.

Figure 12:
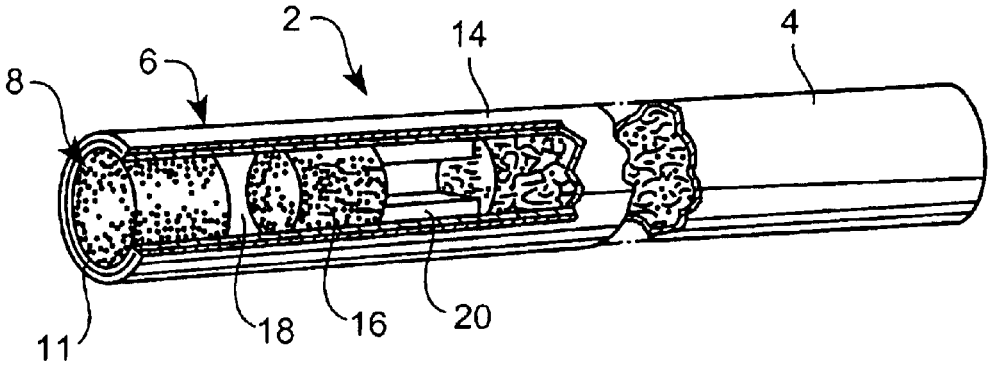
FIG. 12 illustrates a cigarette including another embodiment of the filter having a four-piece filter element with a plug-space-plug arrangement and a hollow sleeve.

FIG. 12 shows a cigarette 2 including a tobacco rod 4 and a filter portion 6. The filter portion 6 includes a mouthpiece filter plug 8, a filter overwrap 11, tipping paper 14 joining the tobacco rod 4 and filter portion 6, a space 18, a plug 16 and a hollow sleeve 20. The filter 30 can be incorporated at one or more locations of the filter portion 6, such as in the space 18, or by substituting the filter 30 for the plug 16 and/or the hollow sleeve 20.

Figure 13:
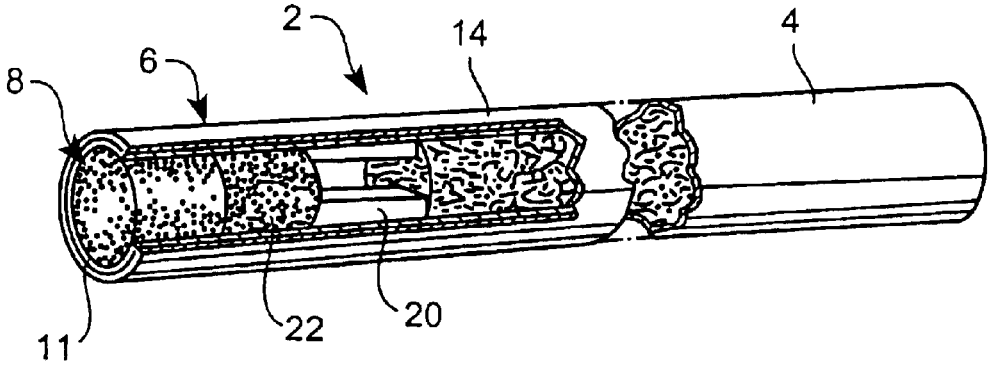
FIG. 13 illustrates a cigarette including a further embodiment of the filter having a three-part filter element with two plugs and a hollow sleeve.
Figure 14:
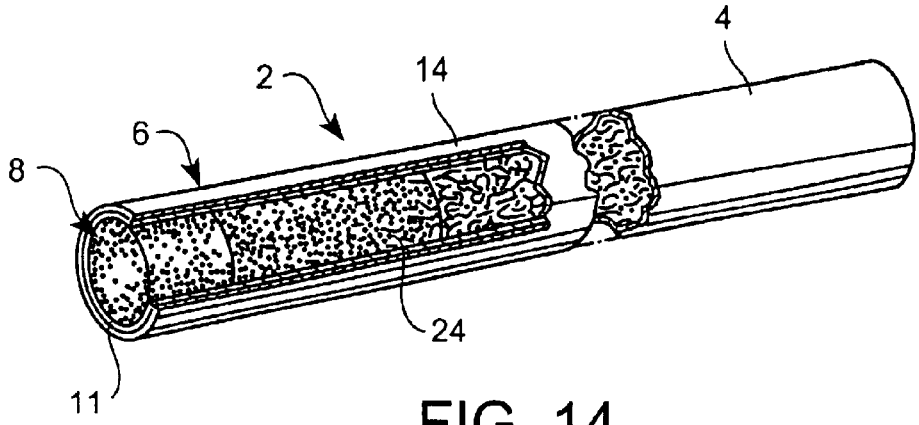
FIG. 14 illustrates a cigarette including yet another embodiment of the filter having a two-part filter element with two plugs.

FIGS. 13 and 14 show further embodiments of the filter portion 6. In the embodiment depicted in FIG. 13, the cigarette 2 includes a tobacco rod 4 and a filter portion 6 joined together with tipping paper 14. The filter portion 6 includes a mouthpiece filter plug 8, a filter overwrap 11, a plug 22 and a hollow sleeve 20. In this embodiment, the filter 30 can be incorporated at one or more locations, such as by replacing the plug 22 and/or sleeve 20 with the filter 30.

In the embodiment shown in FIG. 14, the filter portion 6 includes a mouthpiece filter plug 8 and a plug 24. The tobacco rod 4 and filter portion 6 are joined together by tipping paper 14. The filter 30 can be substituted for the plug 24, for example.

As described above, in some preferred embodiments, the filter 30 is located in a hollow portion of the cigarette filter. For example, as shown in FIG. 10, the filter 30 can be placed in the space of a plug/space/plug filter configuration. As shown in FIGS. 9, 12 and 13, the filter 30 also can be placed in the interior of a hollow sleeve.

Figure 15:
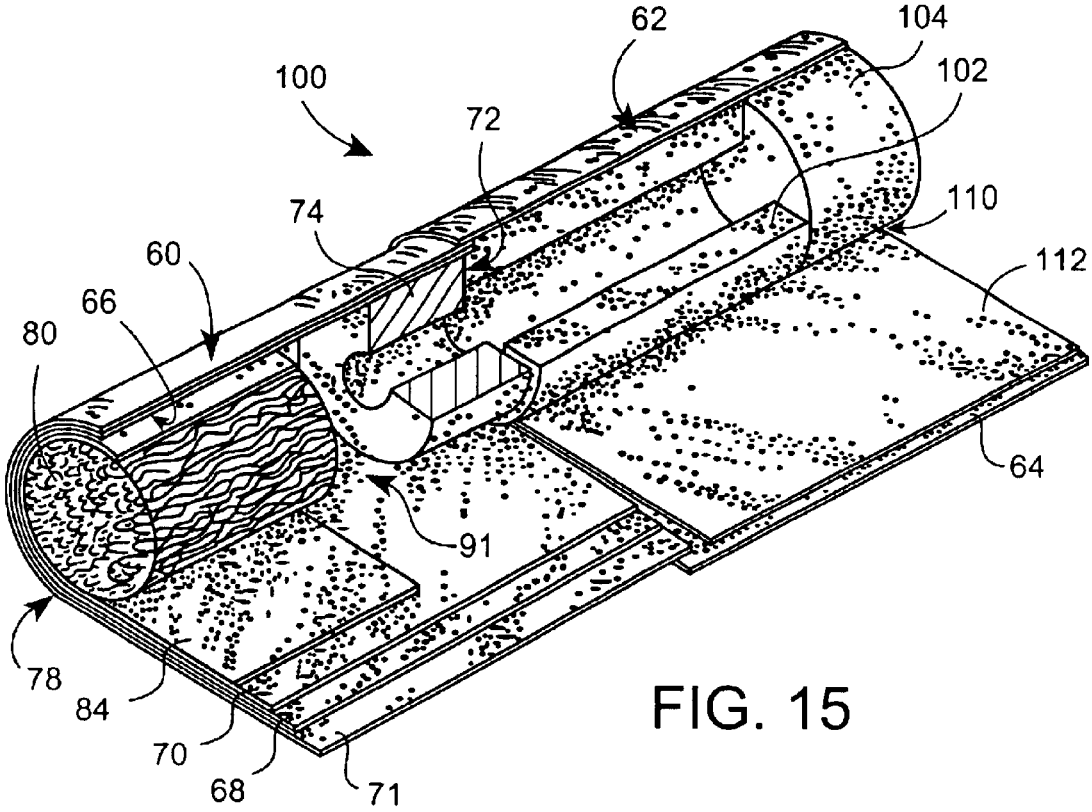
FIG. 15 illustrates an electrically heated cigarette for an electrical smoking system.
Figure 16:
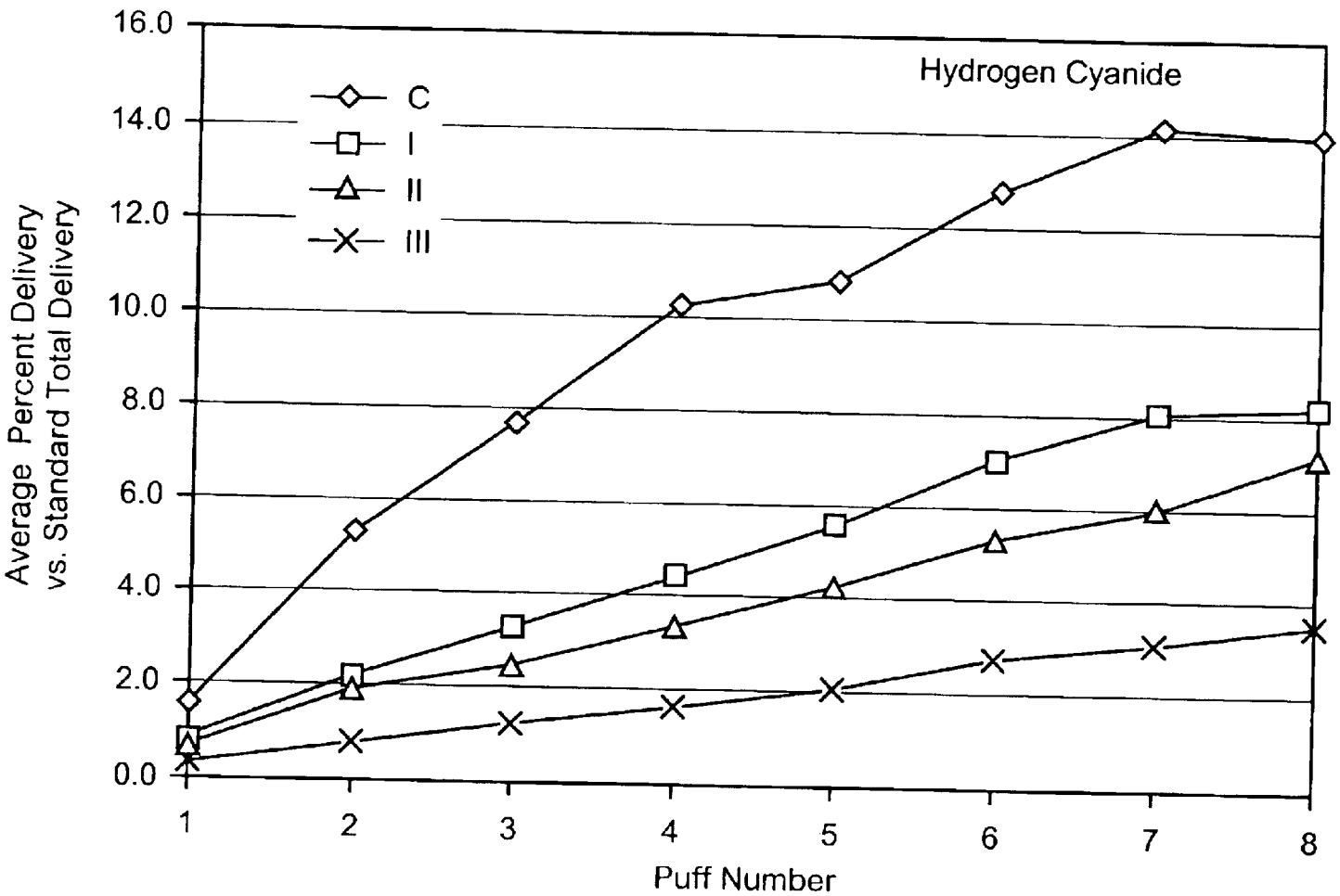
FIG. 16 shows the average percent delivery of hydrogen cyanide for eight separate puffs by a control cigarette, a comparative cigarette and two preferred embodiments of modified cigarettes, versus the total delivery of hydrogen cyanide (for eight puffs) by a standard cigarette.
Figure 17:
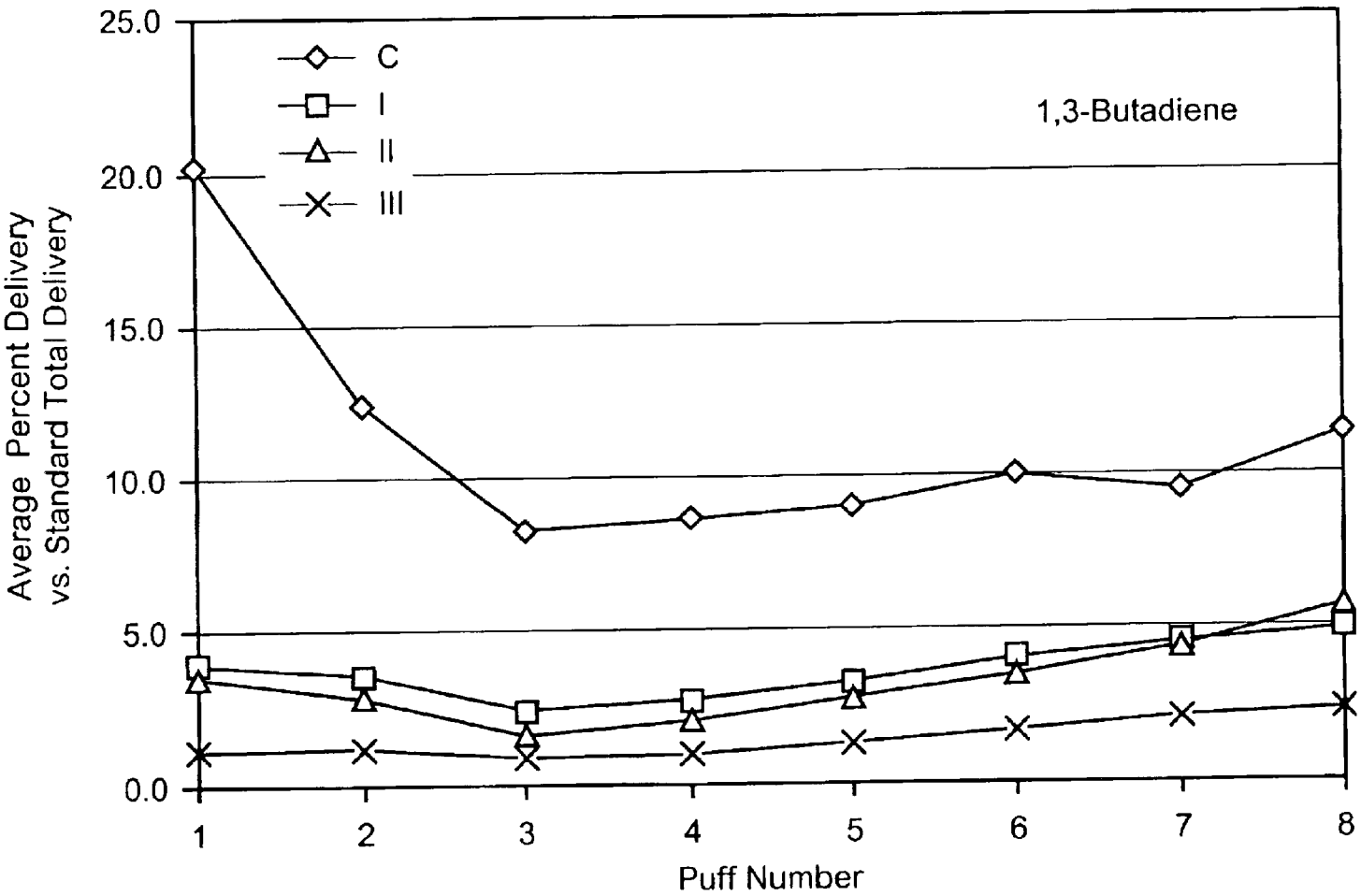
FIG. 17 shows the average percent delivery of 1,3-butadiene for eight separate puffs by a control cigarette, a comparative cigarette and two preferred embodiments of cigarettes, versus the total delivery of 1,3-butadiene (for eight puffs) by a standard cigarette.
Figure 18:
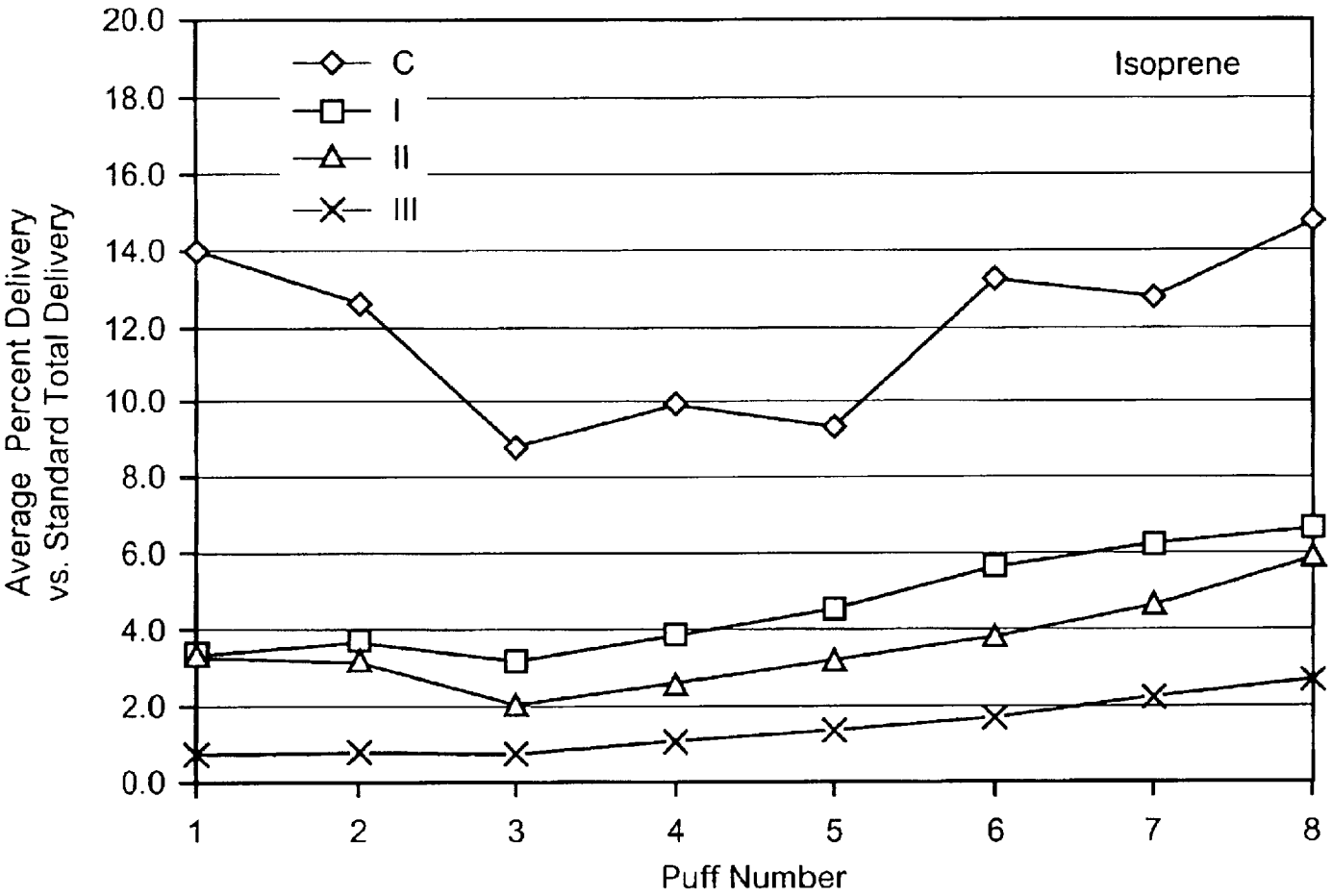
FIG. 18 shows the average percent delivery of isoprene for eight separate puffs by a control cigarette, a comparative cigarette and two preferred embodiments of cigarettes, versus the total delivery of isoprene (for eight puffs) by a standard cigarette.
Figure 19:
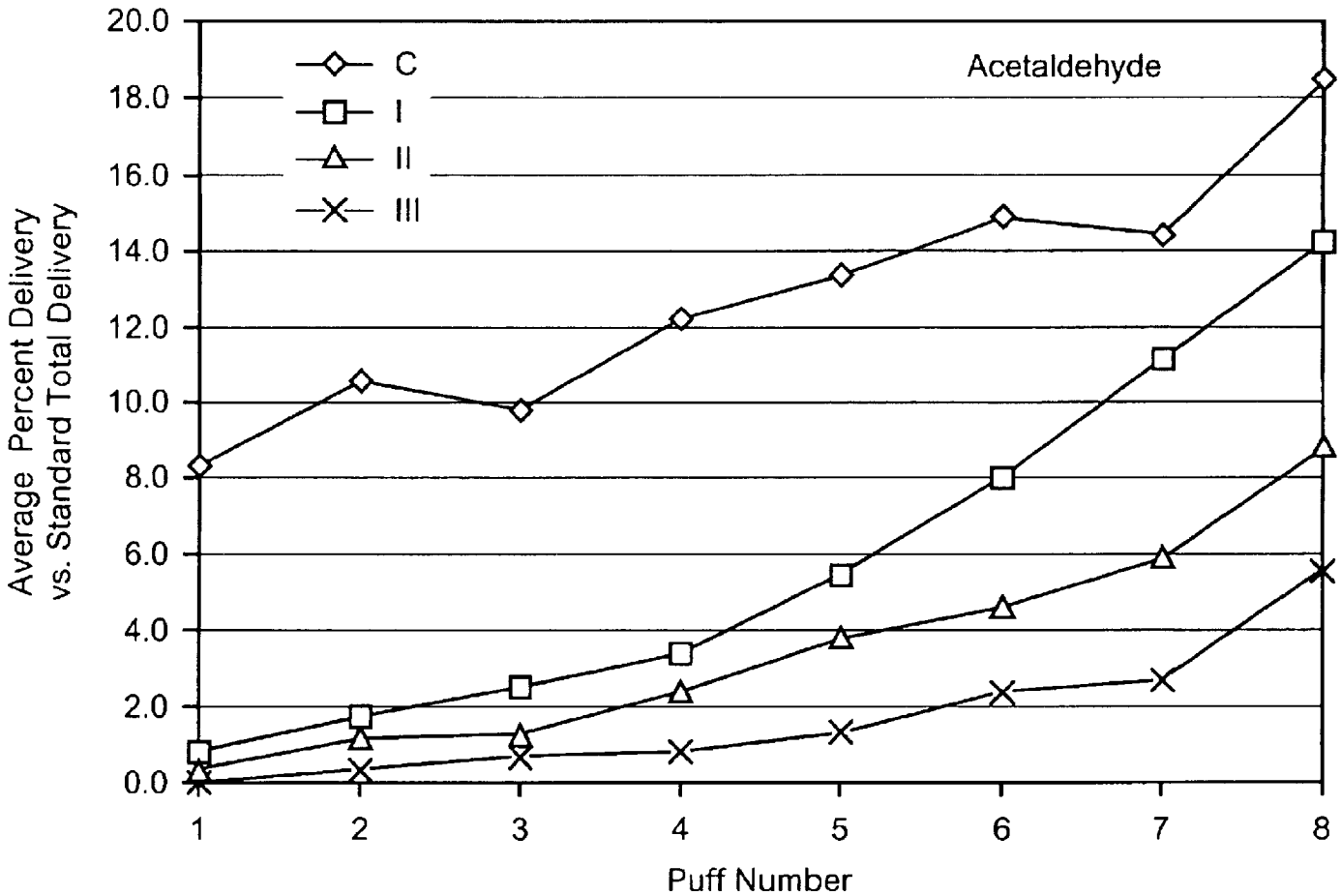
FIG. 19 shows the average percent delivery of acetaldehyde for eight separate puffs by a control cigarette, a comparative cigarette and two preferred embodiments of cigarettes, versus the total delivery of acetaldehyde (for eight puffs) by a standard cigarette.
Figure 20:
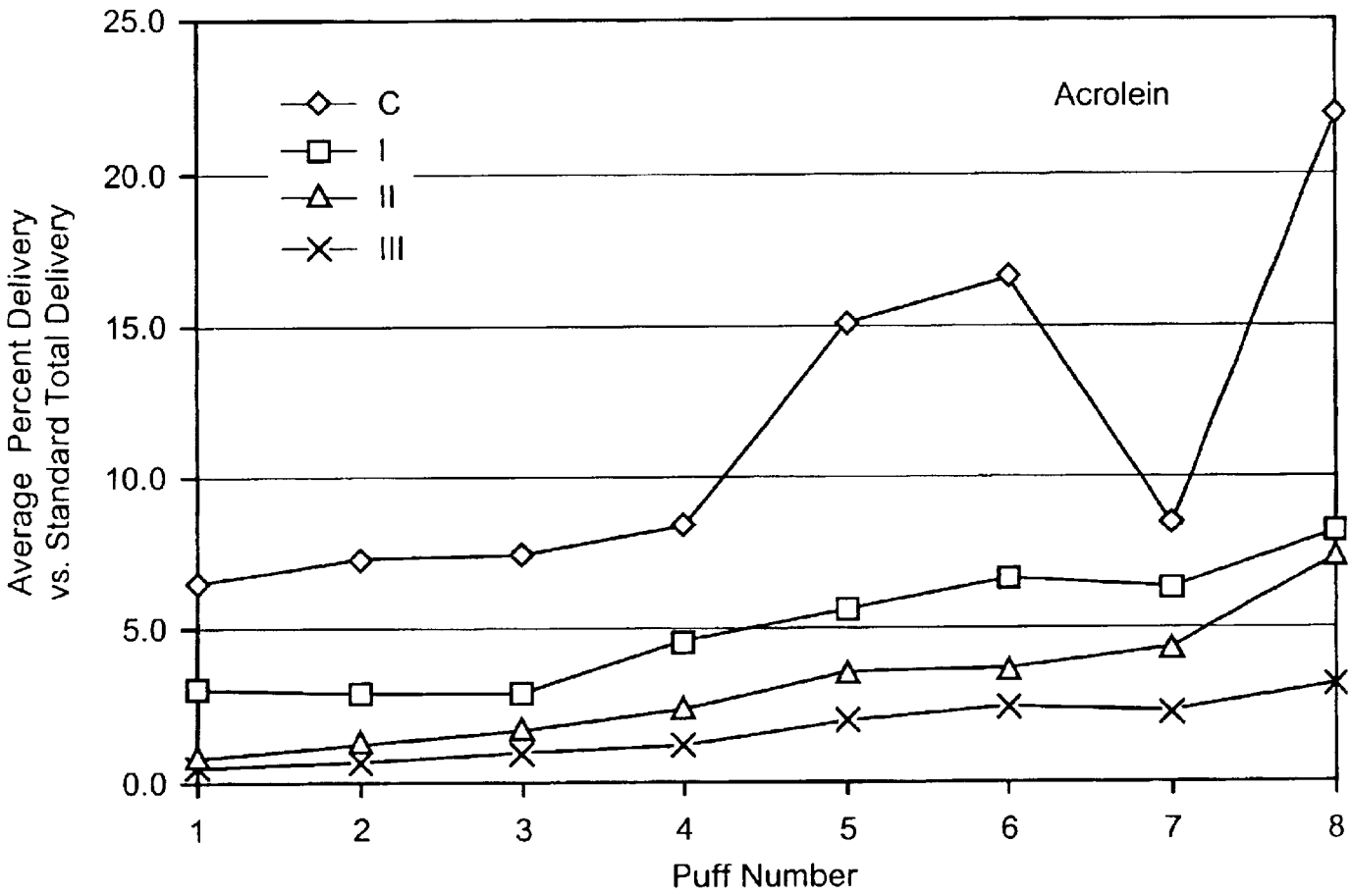
FIG. 20 shows the average percent delivery of acrolein for eight separate puffs by a control cigarette, a comparative cigarette and two preferred embodiments of cigarettes, versus the total delivery of acrolein (for eight puffs) by a standard cigarette.
Figure 21:
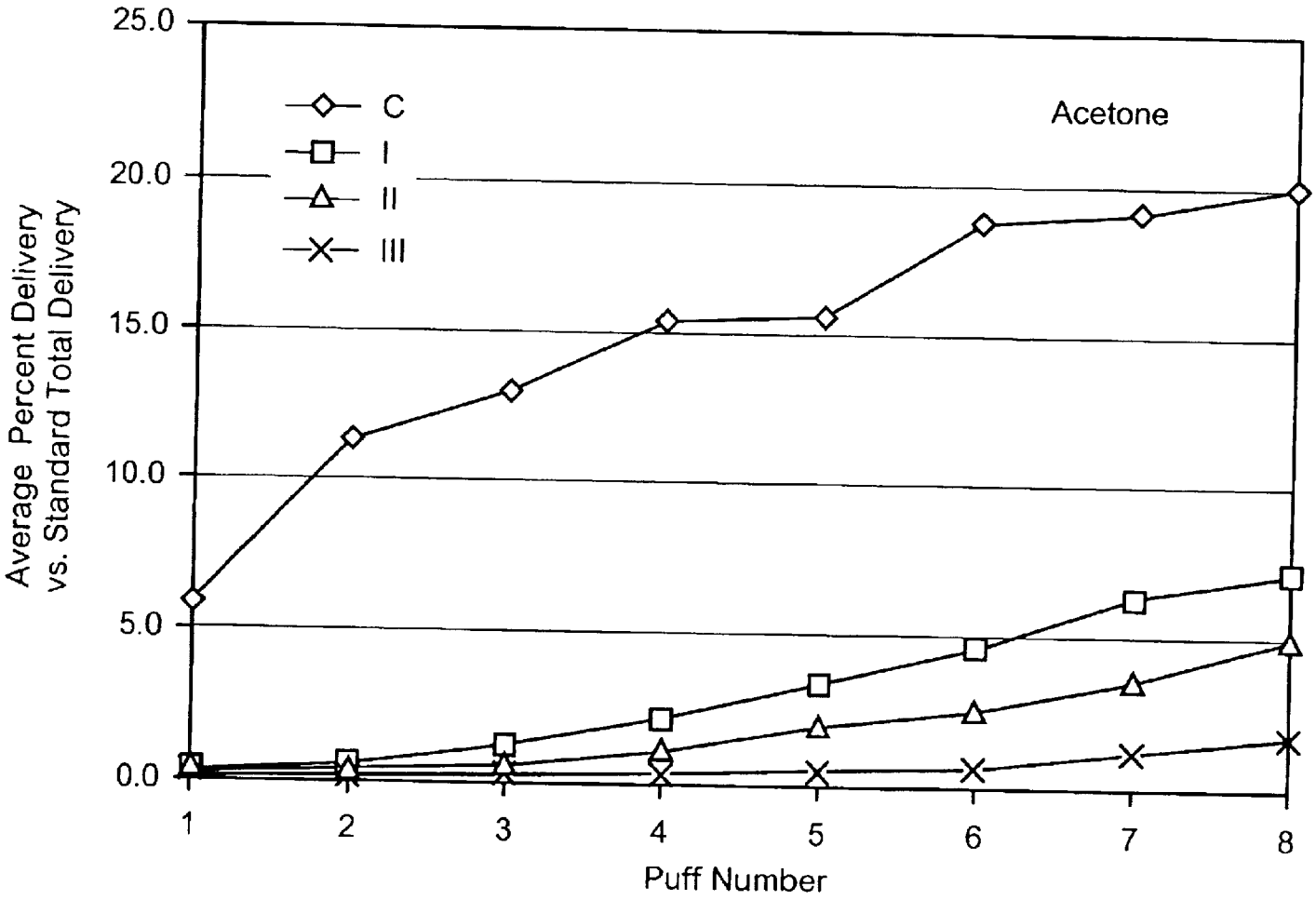
FIG. 21 shows the average percent delivery of acetone for eight separate puffs by a control cigarette, a comparative cigarette and two preferred embodiments of cigarettes, versus the total delivery of acetone (for eight puffs) by a standard cigarette.
Figure 22:
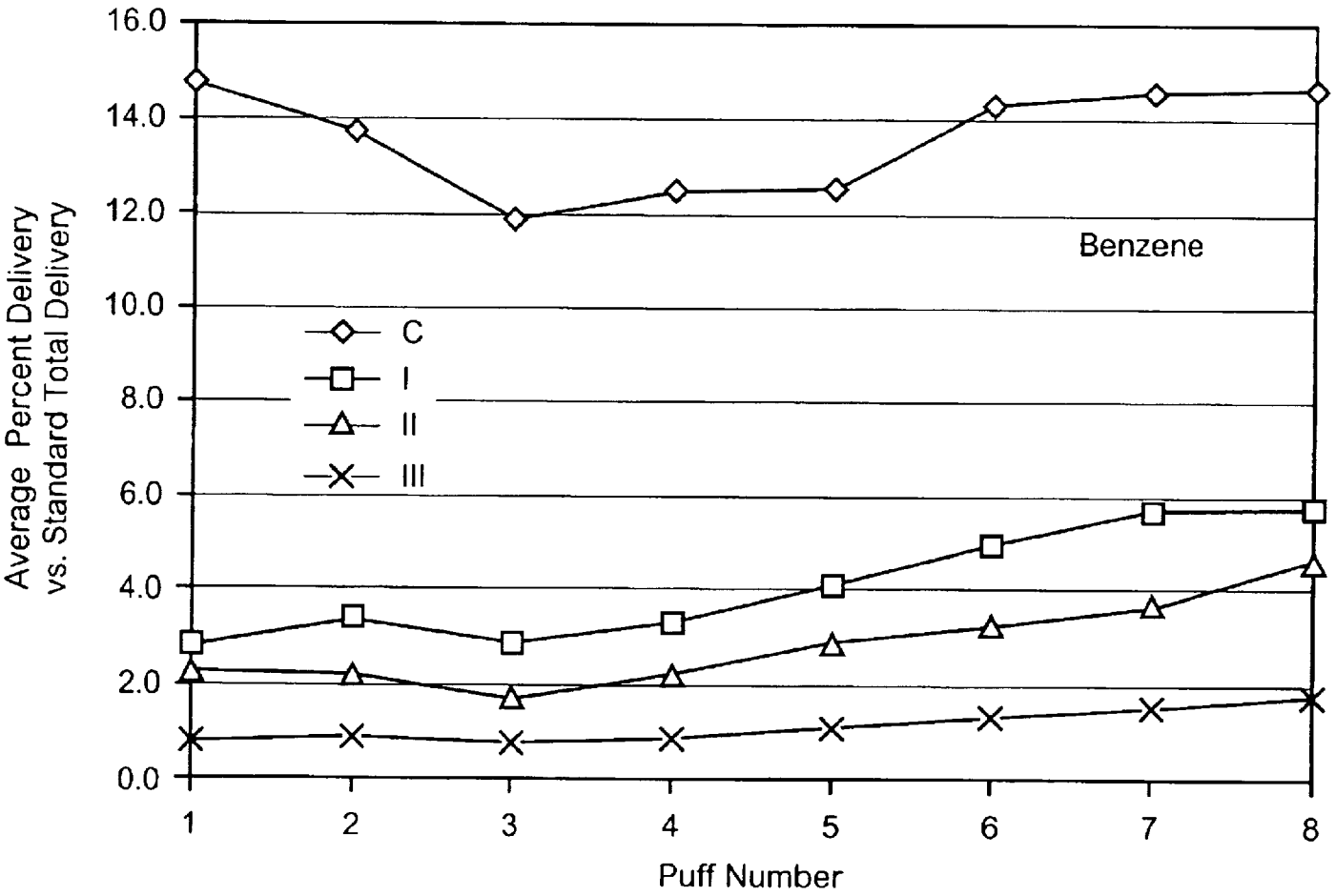
FIG. 22 shows the average percent delivery of benzene for eight separate puffs by a control cigarette, a comparative cigarette and two preferred embodiments of cigarettes, versus the total delivery of benzene (for eight puffs) by a standard cigarette.
Figure 23:
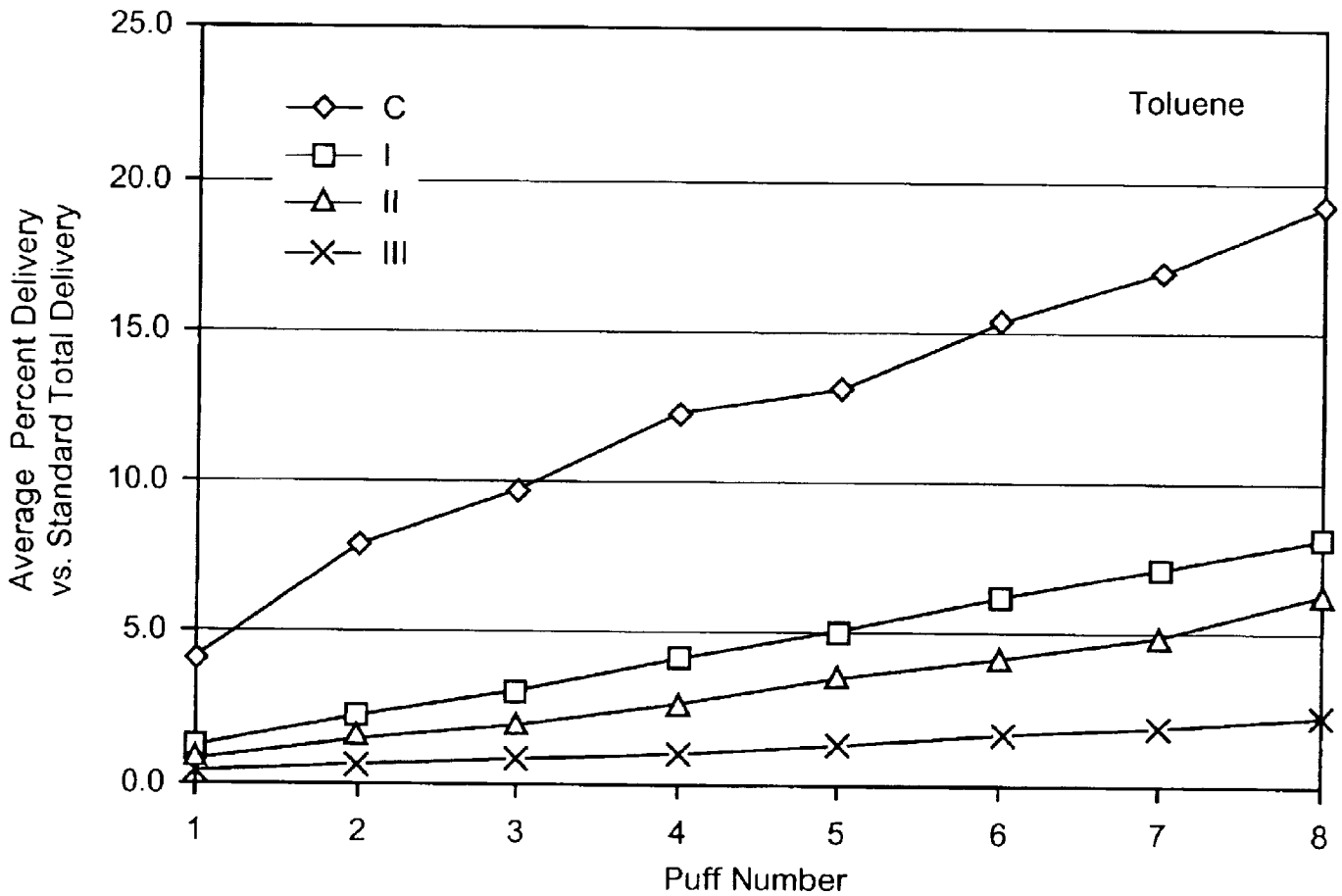
FIG. 23 shows the average percent delivery of toluene for eight separate puffs by a control cigarette, a comparative cigarette and two preferred embodiments of cigarettes, versus the total delivery of toluene (for eight puffs) by a standard cigarette.
Figure 24:
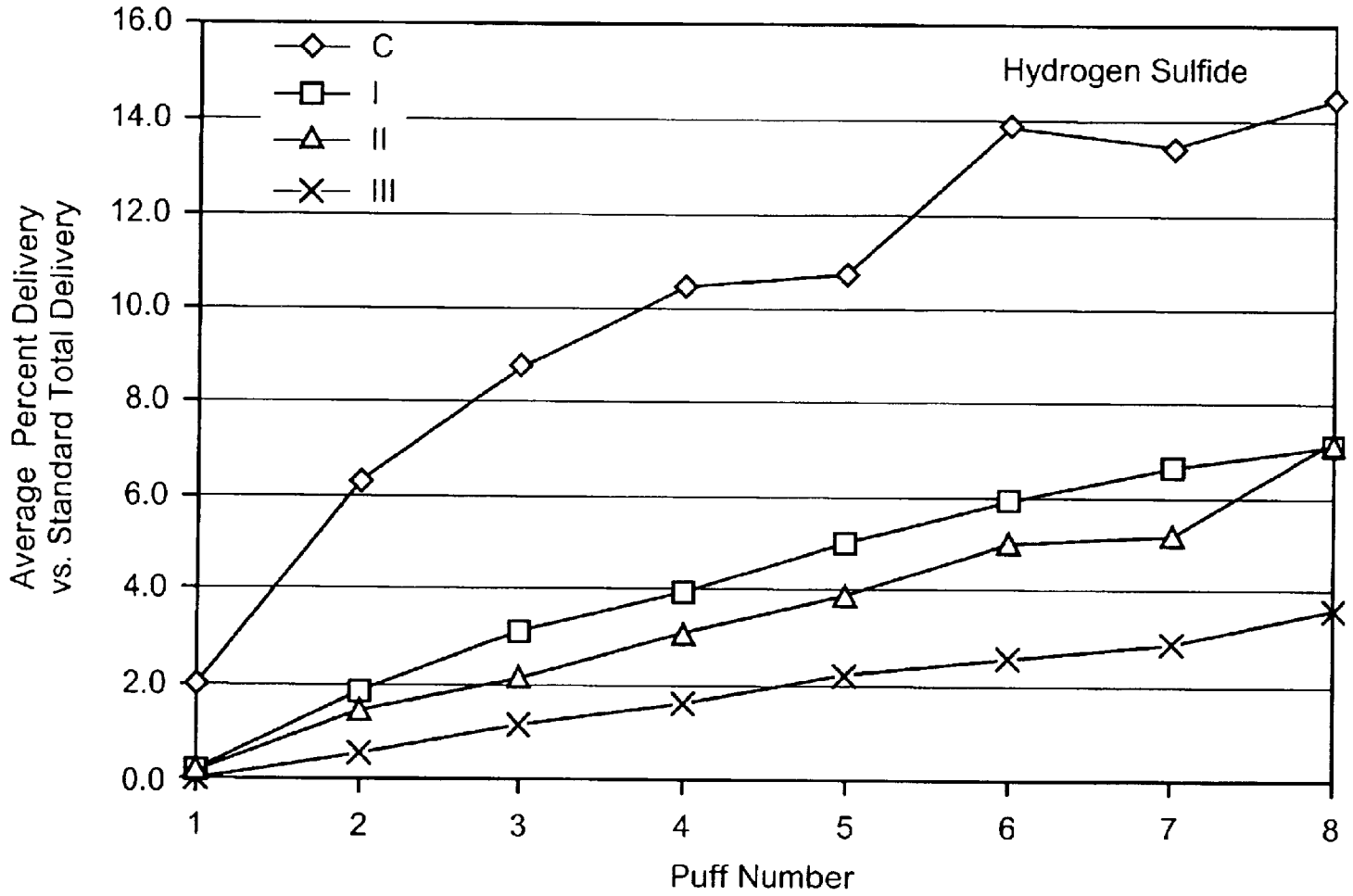
FIG. 24 shows the average percent delivery of hydrogen sulfide for eight separate puffs by a control cigarette, a comparative cigarette and two preferred embodiments of modified cigarettes, versus the total delivery of hydrogen sulfide (for eight puffs) by a standard cigarette.

In another embodiment, the filter 30 is provided in the filter portion of an electrically heated cigarette for an electrical smoking device. See, for example, U.S. Pat. No. 5,692,525, which is hereby incorporated by reference in its entirety. FIG. 15 illustrates an embodiment of a cigarette 100, which can be used with an electrical smoking device. As shown, the cigarette 100 includes a tobacco rod 60 and a filter portion 62 joined by tipping paper 64. The filter portion 62 contains a tubular free-flow filter element 102 and a mouthpiece filter plug 104. The free-flow filter element 102 and mouthpiece filter plug 104 can be joined together as a combined plug 110 with a plug wrap 112. The tobacco rod 60 can have various forms incorporating one or more of an overwrap 71, another tubular free-flow filter element 74 at the tipped end 72 of the tobacco rod 60, a cylindrical tobacco plug 80 preferably wrapped in a plug wrap 84, a tobacco web 66 comprising a base web 68 and tobacco flavor material 70, and a void 91. At the free end 78 of the tobacco rod 60, the tobacco web 66 together with overwrap 71 are wrapped about a cylindrical tobacco plug 80.

The filter 30 can be incorporated at one or more locations of the filter portion 62 of the non-traditional cigarette 100. For example, the filter 30 can be substituted as part of, or in place of, the tubular free-flow filter element 102 and/or the free-flow filter element 74, and/or placed in the void space 91. Further, the filter portion 62 can be modified to create one or more void spaces into which filter 30 can be located.

An exemplary embodiment of a method of making a filter comprises incorporating a filter including two or more monolithic sorbent segments and one or more mixing segments into a cigarette, where the sorbent is capable of selectively removing one or more selected gas-phase constituents from mainstream tobacco smoke. Any conventional or modified method of making cigarette filters may be used to incorporate the filter in the cigarette.

Embodiments of methods for making cigarettes comprise placing a paper wrapper around a tobacco rod, and attaching a cigarette filter to the tobacco rod to form the cigarette. The cigarette contains a filter including two or more monolithic sorbent segments and one or more mixing segments.

Examples of suitable types of tobacco materials that may be used include flue-cured, Burley, Maryland or Oriental tobaccos, rare or specialty tobaccos and blends thereof. The tobacco material can be provided in the form of tobacco lamina; processed tobacco materials, such as volume expanded or puffed tobacco, processed tobacco stems, such as cut-rolled or cut-puffed stems, reconstituted tobacco materials, or blends thereof. Tobacco substitutes may also be used.

In cigarette manufacture, the tobacco is normally in the form of cut filler, i.e., in the form of shreds or strands cut into widths ranging from about 1/10 inch to about 1/20 inch or even 1/40 inch. The lengths of the strands range from between about 0.25 inches to about 3.0 inches. The cigarettes may further comprise one or more flavorants or other additives (for example, burn additives, combustion modifying agents, coloring agents, binders, etc.).

Techniques for cigarette manufacture are known in the art and may be used to incorporate the filter 30. The resulting cigarettes can be manufactured to any desired specification using standard or modified cigarette making techniques and equipment. The cigarettes may range from about 50 mm to about 120 mm in length. Generally, a regular cigarette is about 70 mm long, a "King Size" is about 85 mm long, a "Super King Size" is about 100 mm long, and a "Long" is usually about 120 mm in length. The circumference is from about 15 mm to about 30 mm, and preferably around 25 mm. The packing density is typically between the range of about 100 mg/cm$^3$ to about 300 mg/cm$^3$, and preferably about 150 mg/cm$^3$ to about 275 mg/cm$^3$.

Other preferred embodiments relate to methods of smoking a cigarette as described above, which involve heating or lighting the cigarette to form smoke and drawing the smoke through the cigarette. During the smoking of the cigarette, the sorbent segments of the filter selectively remove one or more selected gas-phase constituents from mainstream smoke.

"Smoking" of a cigarette means the heating or combustion of the cigarette to form tobacco smoke. Generally, smoking of a cigarette involves lighting one end of the cigarette and drawing the cigarette smoke through the mouth end of the cigarette, while the tobacco contained in the tobacco rod undergoes a combustion reaction.

However, the cigarette may also be smoked by other means. For example, the cigarette may be smoked by heating the cigarette using an electrical heater, as described, for example, in commonly-assigned U.S. Pat. Nos. 6,053,176; 5,934,289; 5,591,368 or 5,322,075, each of which is incorporated herein by reference in its entirety.

The following Example further illustrates aspects of the invention. The Example is not meant to and should not be construed to limit the invention in any way.

EXAMPLE

Comparative cigarette I, cigarettes II and III including preferred embodiments of the filter, and a control cigarette (Industry Standard 1R4F) were analyzed for gas phase filtration performance. Comparative cigarette I and cigarettes II and III were each made by modifying an Industry Standard 1R4F cigarette. For comparative cigarette I, a single cylindrical activated carbon monolithic sorbent segment having a diameter of 7.9 mm and a length of 4 mm was placed in a portion of the filter of an Industry Standard 1R4F cigarette having some of the cellulose acetate filter material removed.

For cigarette II, two-cylindrical activated carbon monolithic sorbent segments, each having a diameter of 7.9 mm and a length of 2 mm, were spaced 4 mm apart in the modified filter of an Industry Standard 1R4F cigarette. A cellulose acetate mixing segment having a length of 4 mm was placed between the sorbent segments. For cigarette III, four cylindrical activated carbon monolithic sorbent segments, each having a diameter of 7.9 mm and a length of 1 mm, were placed in the modified filter of an Industry Standard 1R4F cigarette. In cigarette III, the first, second, third and fourth sorbent segments were arranged in the filter in this order, with the first sorbent segment closest to the tobacco rod. The spacing between the first and second sorbent segments and between the second and third sorbent segments was 2 mm, and the spacing between the third and fourth sorbent segments was 6 mm. A cellulose acetate mixing segment was placed between the first and second, second and third, and third and fourth sorbent segments, respectively. Each monolithic sorbent segment in cigarettes I, II and III had thirty-two square flow channels each having dimensions of 1 mm×1 mm. The sorbent segments had a BET specific surface area of 1040 $m^2/g$, a micropore volume of 0.374 $cm^3/g$ and a total pore volume of 0.384 $cm^3/g$.

Two samples of each of control cigarette I, cigarettes II and II, and the control cigarette were smoked under FTC conditions (i.e., 35 $cm^3$ puffs, 2 second duration, once every 60 seconds). Eight puffs of each cigarette were analyzed using a gas chromatography-mass spectroscopy (GC-MS) technique to determine the delivered amount of various gas-phase smoke constituents listed in the Table below. For each of the comparative cigarette I, cigarettes II and II, and the control cigarette, for each of the eight separate puffs, the percent of the gas-phase constituent delivered by the cigarette was compared to a standard. The standard was determined for each gas-phase constituent shown in the Table by averaging the total amount of each respective constituent delivered by seven Industry Standard 1R4F cigarettes. The test results for each pair of comparative cigarettes I, cigarettes II and III, and the control cigarettes, were averaged for each gas-phase constituent and for each of the eight puffs. For example, as shown in the Table, totaling the results for eight puffs for each comparative cigarette I and then averaging the results for the two comparative cigarettes I, comparative cigarette I delivered 39.6% of the amount of hydrogen cyanide, 29.1% of the amount of 1,3-butadiene, 37% of the amount of isoprene, 47.2% of the amount of acetaldehyde, 39.7% of the amount of acrolein, 25.4% of the amount of acetone, 32.8% of the amount of benzene, 37% of the amount of toluene and 33.8% of the amount of hydrogen sulfide, as compared to the standard.

FIGS. 16–24 show the test results for the modified and control cigarettes for the gas-phase constituents hydrogen cyanide, 1,3-butadiene, isoprene, acetaldehyde, acrolein, acetone, benzene, toluene and hydrogen sulfide, respectively, versus the standard. The curves for the control cigarette ("c"), comparative cigarette I ("I"), cigarette II ("II") and cigarette III ("III") are indicated by the symbols ◇, □, Δ, and x, respectively. The curves for each cigarette represent the average for each of the eight puffs of the two cigarettes of that type versus the standard. For example, in FIG. 17, curve I represents the average percent delivered of hydrogen cyanide for each of the eight puffs by cigarette I versus the standard. The total percent of the eight puffs determined by adding these eight values (i.e., 39.6%) is shown in the Table. The test results demonstrate that the modified cigarettes containing two or more monolithic sorbent segments delivered significantly less of each gas-phase constituent, and thus were significantly more efficient, than the unmodified control cigarettes and the comparative cigarettes.

TABLE

| | Total Average Percent Delivered of Constituent (eight puffs) vs. Standard Cigarette | | |
|---|---|---|---|
| Gas-Phase Constituent | Cigarette I | Cigarette II | Cigarette III |
| carbon dioxide | 96.7 | 102.3 | 99.7 |
| propene | 72.5 | 68.8 | 55.6 |
| hydrogen cyanide | 39.6 | 31.2 | 15.3 |
| ethane | 101.5 | 100.2 | 88.6 |
| propadiene | 60.5 | 55.3 | 45.6 |
| 1,3-butadiene | 29.1 | 26.1 | 11.2 |
| isoprene | 37 | 28.7 | 11.2 |
| 1,3-cyclopentadiene | 31.1 | 23.7 | 11.7 |
| 1,3-cyclohexadiene | 29.8 | 20.4 | 6.2 |
| methyl-1,3-cyclopentadiene | 25.9 | 19.7 | 6.4 |
| formaldehyde | 49.8 | 42.7 | 41.2 |
| acetaldehyde | 47.2 | 28.3 | 13.8 |
| acrolein | 39.7 | 24.7 | 12.6 |
| acetone | 25.4 | 15.2 | 4.6 |
| diacetyl | 39.5 | 28.6 | 12.6 |
| methyl ethyl ketone | 34.1 | 21.1 | 8.1 |
| 2-methyl isovaleraldehyde | 44.8 | 30.4 | 13.7 |
| benzene | 32.8 | 22.9 | 9 |
| toluene | 37 | 25.9 | 9.7 |
| isobutryonitrile | 40.8 | 26.7 | 12.6 |
| methyl furan | 34.7 | 24.5 | 11.1 |
| 2,5-dimethyl furan | 40.6 | 28.5 | 11.2 |
| hydrogen sulfide | 33.8 | 28.4 | 14.6 |
| carbonyl sulfide | 83.1 | 80.8 | 68.7 |
| methyl mercaptan | 53.8 | 45.8 | 34.4 |

TABLE-continued

| Gas-Phase Constituent | Total Average Percent Delivered of Constituent (eight puffs) vs. Standard Cigarette | | |
|---|---|---|---|
| | Cigarette I | Cigarette II | Cigarette III |
| 1-methyl pyrrole | 58 | 39.9 | 15 |
| acetylene | 66.7 | 62.8 | 66.8 |

The test results further demonstrate that cigarette filters containing a segmented sorbent including two or more sorbent segments (for example, cigarettes II and III) can remove a greater percentage of selected gas-phase constituents from mainstream smoke than comparative cigarette filters containing only a single sorbent segment (for example, comparative cigarette I). The test results also demonstrate that increasing the number of sorbent segments (for example, from two of cigarette II to four of cigarette III) increases the removal of the selected gas-phase constituents. Cigarettes II and III had the same total length of sorbent; however, cigarette III had twice the total facial surface area of cigarette II. The increased removal of gas-phase constituents by cigarette III as compared to cigarette II is believed to be related to the increased total facial surface area of the sorbent segments in the filter of cigarette III.

Preferred embodiments of the filter including two or more monolithic sorbent segments and at least one mixing segment have been described above with respect to use in smoking articles to remove gas-phase constituents from mainstream tobacco smoke. However, the filter can be used in other applications in which the selective removal of gas-phase constituents from a gas is desired, such as, for example, in catalyst adsorption, treatment of waste flows containing undesirable gases and/or vapors, air filtration, vehicle exhaust filtration, and deodorization.

While the invention has been described in detail with reference to preferred embodiments thereof, it will be apparent to one skilled in the art that various changes can be made, and equivalents employed, without departing from the scope of the invention.

What is claimed is:

1. A filter for gas filtration, comprising:

adjacent first and second monolithic sorbent segments, the first and second monolithic sorbent segments each comprising at least one porous sorbent material; and a first mixing region defined between the first and second monolithic sorbent segments.

2. The filter of claim 1, further comprising:

a third monolithic sorbent segment; and a second mixing region defined between the second and the third monolithic sorbent segments.

3. The filter of claim 1, wherein:

the first monolithic sorbent segment includes a first inlet face, a first outlet face and at least one flow channel extending from the first inlet face to the first outlet face; and the second monolithic sorbent segment includes a second inlet face, a second outlet face and at least one flow channel extending from the second inlet face to the second outlet face.

4. The filter of claim 3, wherein the first monolithic sorbent segment and the second monolithic sorbent segment have different flow channel configurations from each other.

5. The filter of claim 3, wherein at least one of the first inlet face, the second inlet face, the first outlet face and the second outlet face is substantially perpendicular to the axial direction of the filter.

6. The filter of claim 3, wherein at least one of the first inlet face, the second inlet face, the first outlet face, and the second outlet face is oriented at an acute or an obtuse angle relative to the axial direction of the filter.

7. The filter of claim 3, wherein the first outlet face and the second inlet face are oriented at an acute or an obtuse angle relative to the axial direction of the filter.

8. The filter of claim 3, wherein the flow channels of the first and second monolithic sorbent segments have a maximum cross-sectional dimension of from about 0.1 to about 2 mm.

9. The filter of claim 8, wherein the first and second monolithic sorbent segments have different flow channel configurations and/or flow channel dimensions from each other.

10. The filter of claim 1, wherein the first and second monolithic sorbent segments each comprise at least one of (i) activated carbon and (ii) at least one molecular sieve material.

11. The filter of claim 10, wherein the molecular sieve material is at least one zeolite.

12. The filter of claim 1, wherein the first mixing region comprises at least one material selected from the group consisting of cellulose acetate, cellulose triacetate, polypropylene, polyester, activated carbon, silica gel, APS silica gel, molecular sieves and mixtures thereof.

13. The filter of claim 1, wherein the first mixing region is effective to enhance mixing of a gas between the first and second monolithic sorbent segments.

14. The filter of claim 1, which has an axial direction along which gas flows through the filter, and the first and second monolithic sorbent segments each have a length along the axial direction of from about 0.5 mm to about 5 mm.

15. The filter of claim 1, wherein the first and second monolithic sorbent segments are capable of selectively removing at least one of hydrogen cyanide, 1,3-butadiene, isoprene, acetaldehyde, acrolein, acetone, benzene, toluene and hydrogen sulfide from mainstream tobacco smoke.

16. The filter of claim 1, which is a cigarette filter.

17. The filter of claim 1, wherein the first and second monolithic sorbent segments have a BET surface area of about 500 m2/g to about 1,500 m2/g.

18. The filter of claim 1, wherein:

the filter has an axial direction and a dimension perpendicular to the axial direction; and the first and second monolithic sorbent segments each have a maximum dimension substantially equal to the dimension of the filter.

19. The filter of claim 1, wherein the first and second monolithic sorbent segments each have an inlet face and an outlet face, at least one of the inlet face and outlet face being non-planar.

20. The filter of claim 1, wherein the first mixing region is an empty space.

21. The filter of claim 1, wherein the first and second monolithic sorbent segments have a different composition from each other.

22. The filter of claim 1, further comprising a sleeve surrounding the first and second monolithic sorbent segments and the first mixing region.

23. A method of making a cigarette filter, comprising incorporating the filter according to claim 1 in a cigarette filter.

24. A method of making a cigarette, comprising attaching the filter according to claim 1 to a tobacco rod using paper to form the cigarette.

25. A cigarette comprising:

a filter including:

adjacent first and second monolithic sorbent segments, the first and second monolithic sorbent segments each comprising at least one porous sorbent material;

at least a first mixing region defined between the first and second monolithic sorbent segments; and tobacco attached to the filter.

26. The cigarette of claim 25, which is an electrically heated cigarette.

27. A method of smoking the cigarette according to claim 25, comprising lighting the cigarette to form smoke and drawing the smoke through the cigarette, the first and second porous monolithic sorbent segments removing at least one selected gas-phase constituent from mainstream smoke.

28. A cigarette filter, comprising:

a first monolithic sorbent segment including a first inlet face, a first outlet face and a plurality of first flow channels extending from the first inlet face to the first outlet face, the first monolithic sorbent segment comprising at least one porous sorbent material;

a second monolithic sorbent segment including a second inlet face, a second outlet face and a plurality of second flow channels extending from the second inlet face to the second outlet face, the second monolithic sorbent segment comprising at least one porous sorbent material; and a first mixing region defined between the first monolithic sorbent segment and the second monolithic sorbent segment.

29. The cigarette filter of claim 28, wherein the first and second flow channels have different configurations and/or diameters from each other.

30. The cigarette filter of claim 28, wherein the first flow channels and/or second flow channels have a non-circular cross-section.

31. The cigarette filter of claim 28, wherein the first inlet face and the second inlet face are substantially perpendicular to the axial direction of the filter.

32. The cigarette filter of claim 28, wherein the first flow channels and/or second flow channels are substantially parallel to the axial direction of the filter.

33. The cigarette filter of claim 28, wherein the first flow channels and/or second flow channels are non-parallel to the axial direction of the filter.

34. The cigarette filter of claim 28, wherein (i) the first inlet face and the second inlet face, or (ii) the first outlet face and the second inlet face, are oriented at an acute or an obtuse angle relative to the axial direction of the filter.

35. The cigarette filter of claim 28, wherein the first flow channels and second flow channels have a maximum cross-sectional dimension of from about 0.1 to about 2 mm.

36. The cigarette filter of claim 28, wherein the first and second monolithic sorbent segments each comprise activated carbon.

37. The cigarette filter of claim 28, wherein the first mixing region comprises at least one material selected from the group consisting of cellulose acetate, cellulose triacetate, polypropylene, polyester, activated carbon, silica gel, APS silica gel, molecular sieves and combinations thereof.

38. The cigarette filter of claim 28, wherein the first mixing region enhances mixing of gas between the first monolithic sorbent segment and the second monolithic sorbent segment.

39. The cigarette filter of claim 28, wherein the first and second monolithic sorbent segments are capable of selectively removing at least one of hydrogen cyanide, 1,3-butadiene, isoprene, acetaldehyde, acrolein, acetone, benzene, toluene and hydrogen sulfide from mainstream tobacco smoke.

40. The cigarette filter of claim 28, wherein:

the filter has an axial direction and a dimension perpendicular to the axial direction; and the first and second monolithic sorbent segments each have a maximum dimension substantially equal to the dimension of the filter.

41. A method of making a cigarette filter, comprising incorporating the cigarette filter according to claim 28 in a cigarette filter.

42. A method of making a cigarette, comprising attaching the cigarette filter according to claim 28 to a tobacco rod to form the cigarette.

43. A cigarette, comprising:

a cigarette filter including:

a first monolithic sorbent segment including a first inlet face, a first outlet face and a plurality of first flow channels extending from the first inlet face to the first outlet face, the first monolithic sorbent segment comprising at least one porous sorbent material;

a second monolithic sorbent segment including a second inlet face, a second outlet face and a plurality of second flow channels extending from the second inlet face to the second outlet face, the second monolithic sorbent segment comprising at least one porous sorbent material; and a mixing region defined between the first monolithic sorbent segment and the second monolithic sorbent segment; and tobacco attached to the cigarette filter.

44. The cigarette of claim 43, which is an electrically heated cigarette.

45. A method of smoking the cigarette of claim 43, comprising lighting the cigarette to form smoke and drawing the smoke through the cigarette, the first and second monolithic sorbent segments removing at least one selected gas-phase constituent from mainstream smoke.

* * * * *